US006012319A

United States Patent [19]

Narita et al.

[11] Patent Number: 6,012,319

[45] Date of Patent: Jan. 11, 2000

[54] ROLLING MILL AND ROLLING METHOD

[75] Inventors: Kenjiro Narita, Hitachinaka; Mitsuo Nihei, Hitachi; Kenichi Yasuda, Hitachinaka; Takehiko Saito, Hitachi; Yukio Hirama, Mito; Kouji Satou, Hitachi, all of Japan

[73] Assignee: Hitachi, Ltd., Japan

[21] Appl. No.: 08/998,655

[22] Filed: Dec. 29, 1997

[30] Foreign Application Priority Data

Dec. 27, 1996 [JP] Japan ..... 8-350093

[51] Int. Cl.[7] ..... B21B 13/14; B21B 31/07

[52] U.S. Cl. ..... 72/241.2; 72/41

[58] Field of Search ..... 72/241.2, 241.4, 72/41, 42, 43, 247, 201, 236, 241.6, 241.8

[56] References Cited

U.S. PATENT DOCUMENTS

| | | | |
|---|---|---|---|
| 5,524,465 | 6/1996 | Kajiwara et al. | 72/42 |
| 5,655,398 | 8/1997 | Ginzburg | 72/241.4 |
| 5,768,927 | 6/1998 | Kajiwara et al. | 72/241.4 |

FOREIGN PATENT DOCUMENTS

| | | | |
|---|---|---|---|
| 50-24903 | 8/1975 | Japan . | |
| 52-1701 | 1/1977 | Japan . | |
| 58-157504 | 9/1983 | Japan | 72/241.2 |
| 61-279305 | 12/1986 | Japan . | |
| 5-50110 | 3/1993 | Japan . | |
| 6-31304 | 2/1994 | Japan . | |

OTHER PUBLICATIONS

Mitubishi Heavy Industry Technial Report, vol. 21, No. 6 (1984) pp. 61–67.

*Primary Examiner*—Rodney Butler
*Attorney, Agent, or Firm*—Evenson, McKeown, Edwards, & Lenahan, P.L.L.C.

[57] ABSTRACT

A rolling mill is provided with a pair of work rolls 2, a pair of intermediate rolls 3 and a pair of backup rolls 4 in a mill stand 5, wherein the pair of backup rolls are arranged so that their axial lines cross perpendicularly a plate travelling direction and do not incline to the direction in a horizontal plane, the intermediate rolls and work rolls are arranged so that the axial lines of the intermediate rolls and the axial line of the work rolls incline to (cross) the axes of the backup rolls in a counter direction to each other in a horizontal plane, and a lubricant supplying apparatus 6 is provided for supplying a lubricant to the roll surfaces.

55 Claims, 14 Drawing Sheets

COMPARATIVE EXAMPLE 1

COMPARATIVE EXAMPLE 2

COMPARATIVE EXAMPLE 3

COMPARATIVE EXAMPLE 5

COMPARATIVE EXAMPLE 6

ROLLING MILL AND ROLLING METHOD

BACKGROUND OF THE INVENTION

The present invention relates to a rolling mill and a rolling method and, particularly, to a rolling mill and rolling method each of which is suitable for rolling a metal plate required for particularly excellent quality.

In the field of plate rolling, improvement of the quality is always required, and various types of rolling mills have been proposed to improve precision in size of plates. For example, JP B 50-24903 and JP B 52-1701 each proposes a 6-high mill which is provided with work rolls, intermediate rolls and backup rolls in rolling stands and in which the intermediate rolls are arranged to cross an imaginary line perpendicular to a rolling direction (which is simply referred to such that the roll or rolls cross), and a rolling method thereby. According to the prior art, the intermediate rolls are arranged so that they are able to be inclined with respect to the imaginary line in a horizontal plane and plate thickness distribution in a plate width direction can be changed by changing the inclination angle, so that a large improvement of control ability for thickness distribution is expected. Further, since load from portions of the backup rolls that the work rolls and a plate are not in contact with each other can be decreased to a small load, it is expected that the plate thickness distribution in the plate width direction can be easily corrected for a short time by jointly using this inclination adjusting method and a roll bending method.

Further, JP A 61-279305 proposes a technique of using special rolls which enables axial shift of barrel sleeves of rolling rolls and effecting simultaneously axial shift of the rolls and crossing of the rolls. As for a 6-high mill, it discloses a rolling mill in which intermediate rolls and backup rolls, or the intermediate rolls and work rolls are arranged to cross as a unit. According to this conventional technique, it is expected to improve greatly a control ability of thickness distribution by enabling the rolling rolls to incline in a horizontal plane and changing the inclination angle, as in the above-mentioned technique.

A further technique of reducing the thrust force in a 6-high mill of a type in which work rolls cross is disclosed in JP A 6-31304. In this conventional technique, shape control is effected by crossing the work rolls of the 6-high mill, and the thrust force is measured and the intermediate rolls are crossed in a counter direction so as to cancel the thrust force.

On the other hand, an example of rolling mills put into practice as a rolling mill of a type in which rolling rolls cross is a 4-high mill of pair cross type in which a roll pair of upper work roll and upper backup roll and a roll pair of lower work roll and lower backup roll, each roll pair crosses as one roll pair unit, which is reported in "MITUBISHI HEAVY INDUSTRY TECHNICAL REPORT" Vol.21, No.6 (1984)", pages 61–67. Further, another example of rolling mills being put into practice is a 4-high mill in which only work rolls are enabled to cross and a lubricant supplying apparatus is provided for supplying lubricant between rolls, which is disclosed in JP A 5-50110.

In the 4-high mill, since the work rolls are driven, the work rolls of relatively large diameter are used. However, small diameter rolls are suitable for rolling of a hard material or a thin material. For such materials, multi-stage mills and 6-high mills are used in many cases.

As conventional rolling mills of a type using crossing of rolling rolls, there are 6-high mills and 4-high mills, as mentioned above. However, any rolling mills which have succeeded in practice are 4-high mills, and there is no example of a 6-high mill which has succeeded in practice. The reason is that occurrence of thrust force is a problem in the case of crossing rolling rolls and it is essential to decrease the thrust force in order to practice them.

In the 4-high mills disclosed in the "MITUBISHI HEAVY INDUSTRY TECHNICAL REPORT Vol. 21, No.6(1984)" and JP A 5-50110, any types of them employ a specific device to decrease axial thrust force caused by crossing the work rolls.

That is, as the axial thrust force caused by crossing the work rolls, there are axial thrust force caused between the work rolls and intermediate rolls and axial thrust force caused between the work rolls and a plate. In a 4-high mill of pair crossing type, the axial thrust force between the work roll and the backup, of them, is prevented to occur by arranging the backup rolls and the work rolls to cross along the same axis. Further, in the type of 4-high mill that crosses only the work rolls, the thrust force occurring between the work rolls and backup rolls is decreased by supplying lubricant between rolls, and cancelled by the thrust force occurred between the plate and the work rolls, whereby the thrust force occurring in the work rolls is decreased in total.

On the other hand, the JP B 50-24903, JP B 52-1701 and JP A 61-279305 each disclose 6-high mills, however, none of them discuss (discussion of reduction of the axial thrust force) concerning the axial thrust force caused by crossing rolling rolls, and does not take any special device for decreasing the axial thrust force caused by crossing rolls. Therefore, excessive large axial thrust force occurs on the work rolls and intermediate rolls during rolling, whereby the rolling becomes impossible to succeed any more.

In the 6-high mill disclosed in JP A 6-31304, such a device is employed that the thrust force occurring on the work rolls is measured and the intermediate rolls are crossed in a counter direction so as to cancel the thrust force. However, according to the study by the inventors of the present application, the thrust force can not be decreased substantially only by crossing the work rolls and intermediate rolls in a counter direction to each other, and it is found that the excessive large axial thrust force occurs still on the work rolls during rolling and the rolling become impossible to succeed further.

Further, the following fact was found. That is, even if lubrication between rolls (inter-roll lubrication) is employed in the 6-high mill disclosed in JP A 6-31304 in the manner as described in JP 5-50110, in a case where thrust force of the work rolls increases during rolling by any causes, it is difficult to decrease the thrust force by changing a cross angle of the intermediate roll.

Further, in the 6-high mill disclosed in JP A 6-31304, shape control of a plate is effected by changing a cross angle of the work rolls. However, the following was found, that is, changing of the cross angle of the work roll changes largely the thrust force occurring on the work roll, there occurs a difference between right and left loads with respect to an axial center of the work roll because of mill center moment changes, and the difference between the right and left loads becomes a cause of erroneous correction of thickness distribution of a rolling plate material.

SUMMARY OF THE INVENTION

A first object of the present invention is to provide, in a type of 6-high mill in which intermediate rolls and work rolls cross, a mill and rolling method, which is able to suppress occurrence of excessively large thrust force by roll crossing, secure a uniform thickness distribution and produce plates of excellent quality.

A second object of the present invention is to provide, in a type of 6-high mill in which intermediate rolls and work rolls cross, a mill and rolling method, which, even if thrust force of the work rolls increases during rolling, is able to reduce surely the thrust force, suppress an influence of correction of thickness distribution on a load difference between right and left sides to be small, secure a uniform thickness distribution and produce plates of excellent quality.

(A) Means for solving the problems in the prior arts according to the present invention and features accompanied by the means are as follows:

(1) First of all, in order to achieve the above first object, there is provided a means according to the present invention, which resides in a rolling mill which comprises a pair of work rolls for rolling a plate, a pair of intermediate rolls supporting the pair of work rolls, respectively and a pair of backup rolls supporting the pair of intermediate rolls, respectively, in a mill stand, wherein the pair of backup rolls are arranged so that the axial lines of the pair of backup rolls do not incline to each other in a horizontal plane, the intermediate rolls and work rolls are arranged so that each of the axial lines of the intermediate rolls and work rolls can incline, in a counter direction to each other, to the axial lines of the backup rolls in a horizontal plane, and a lubricant supplying apparatus is provided for supplying lubricant to the roll surfaces of the work rolls, intermediate rolls and backup rolls.

(2) In the above item (1), preferably, a cross angle of the work roll is set so that the thrust force occurring at the work roll does not become excessively large, and the cross angle of the work roll is taken into consideration and a cross angle of the intermediate rolls is set so that the plate has a desired thickness distribution.

(3) In the above item (1), preferably, when an angle of each work roll to a direction perpendicular to a rolling direction of the plate is defined as a cross angle of work roll and an angle of each intermediate roll to a direction perpendicular to a rolling direction of the plate is defined as a cross angle of intermediate roll, a cross angle of the work roll is set to 0.2 degrees or more, and a cross angle of the intermediate roll is set to 0.1 degrees or more in a counter direction to the work roll.

(4) Further, in the above item (1), preferably, a roll bender is provided for imparting bending force on the work rolls or/and the intermediate rolls.

(5) In the above-mentioned item (4), preferably, as the roll bender, a work roll bender is provided for imparting bending force to the work rolls in a horizontal direction.

(6) In the above-mentioned item (1), preferably, a roll shift apparatus is provided which is able to shift the work rolls and/or the intermediate rolls in an axial direction.

(7) In the above-mentioned items (1) to (6), preferably, the lubricant is a lubrication oil comprising mineral oil as a base oil, and rolling is done hot.

(8) In the above-mentioned items (1) to (6), preferably, the rolling mill comprises further a cooling water supplying apparatus for supplying cooling water to the work rolls and a cooling water shielding member arranged at a position adjacent to the work rolls for preventing the cooling water from adhering to the intermediate rolls, and effects hot rolling.

(9) In the above-mentioned items (1) to (6), preferably, a coolant supplying apparatus is further provided for supplying coolant to the work rolls, the lubricant is a lubricant different in oily property or concentration from the coolant for the work rolls, and cold rolling can be effected.

(10) In the above-mentioned items (1) to (6), preferably, the rolling mill comprises a coolant supplying apparatus for supplying coolant to the work rolls and a coolant shielding member arranged at a position adjacent to the work rolls for preventing the coolant being adhered to the intermediate rolls, and can effect cold rolling.

(11) Further, in order to achieve the above second object, there is provided a means according to the present invention, which resides in a rolling mill which comprises a pair of work rolls for rolling a plate, a pair of intermediate rolls supporting the pair of work rolls, respectively and a pair of backup rolls supporting the pair of intermediate rolls, respectively, in mill stands, wherein the pair of backup rolls are arranged so that the axial lines of the pair of backup rolls do not incline to each other in a horizontal plane, the intermediate rolls and work rolls are arranged so that each of the axial lines of the intermediate rolls and work rolls can incline, in a counter direction to each other, to the axial lines of the backup rolls in a horizontal plane, and the above-mentioned rolling mill comprises a lubricant supplying apparatus for supplying lubricant to the roll surfaces of the work rolls, intermediate rolls and backup rolls, a work roll thrust force measuring unit for measuring thrust force of the work rolls in an axial direction, a thrust force setting unit for setting an allowable thrust force, a work roll cross angle arithmetic unit for comparing a set value from the thrust force setting unit and a measured value of the thrust force and calculating a change amount of cross angle of the work rolls, an intermediate roll cross angle arithmetic unit for calculating a change amount of cross angle of the intermediate rolls according to the change amount of cross angle of the work rolls, a work roll cross angle changing unit for receiving a signal from the work roll cross angle arithmetic unit and changing the cross angle of the work rolls, and an intermediate roll cross angle changing unit for receiving a signal from the intermediate roll cross angle arithmetic unit and changing the cross angle of the intermediate rolls.

(12) In the above-mentioned item (11), preferably, the work roll cross angle arithmetic unit calculates such a change amount of the cross angle of the work rolls that when the measured value of thrust force is larger than the set value from the thrust force setting unit, a difference from the set value becomes small, and the intermediate roll cross angle arithmetic unit calculates such a change amount of the cross angle of the intermediate rolls that a change amount in thickness distribution of the plate due to the change amount of the cross angle of the work rolls is cancelled.

(13) In the above-mentioned item (11), preferably, in a case where an angle of each work roll to a direction perpendicular to a rolling direction of the plate is defined as a cross angle of the work roll and an angle of each intermediate roll to a direction perpendicular to a rolling direction of the plate is defined as a cross angle of the intermediate roll, the work roll cross angle arithmetic unit obtains a change amount of the cross angle of the work rolls in a range in which the cross angle of the work roll is 0.2 degrees or more, the intermediate roll cross angle arithmetic unit obtains an change amount of the cross angle of the intermediate rolls in a range in which the cross angle of the intermediate roll is 0.1 degrees or more in a counter direction to the work roll.

(14) Further, in order to achieve the above first object, according to the present invention, provided is a rolling method of rolling a plate, using a rolling mill provided with a pair of work rolls, a pair of intermediate rolls supporting the pair of work rolls, respectively and a pair of backup rolls supporting the pair of intermediate rolls, respectively, in mill stands, which method arranges the pair of backup rolls so that the axial lines of the pair of backup rolls do not incline to each other in a horizontal plane, arranges the intermediate rolls and work rolls so that each of the axial lines of the intermediate rolls and work rolls can incline, contrarily to each other, to the axial lines of the backup rolls in a horizontal plane, and rolls a plate while supplying a lubricant to the roll surfaces of the work rolls, intermediate rolls and backup rolls.

(15) In the above-mentioned item (14), preferably, in the case of rolling the plate, a cross angle of the work rolls is set so that the thrust force occurred in the work rolls does not become excessively large, and a cross angle of the intermediate rolls are set so that the plate has a desired thickness distribution, taking into consideration the cross angle of the work rolls.

(16) In the above-mentioned item (14), preferably, in a case where an angle of each work roll to a direction perpendicular to a rolling direction of the plate is defined as a cross angle of the work roll and an angle of each intermediate roll to a direction perpendicular to a rolling direction of the plate is defined as a cross angle of the intermediate roll, when the plate is rolled, a cross angle of the work roll is set 0.2 degrees or more, and a cross angle of the intermediate roll is set 0.1 degrees or more in a counter direction to the work roll.

(17) In the above-mentioned item (14), preferably, the plate is rolled by imparting bending force on the work rolls or/and the intermediate rolls.

(18) In the above-mentioned item (17), preferably, as the bending force to be imparted to the work roll, bending force is imparted to the work rolls in a horizontal direction and the plate is rolled.

(19) In the above-mentioned item (14), preferably, the plated is rolled by shifting the work rolls or/and the intermediate rolls in an axial direction.

(20) In the above-mentioned items (14) to (19), preferably, the plate is cold rolled while supplying a coolant to the work rolls and using, as the lubricant, a lubricant different in oily property or concentration from the coolant for the work rolls.

(21) Further, in the above-mentioned items (14) to (19), preferably, the plate is cold rolled while supplying coolant to the work rolls and preventing the coolant from adhering to the intermediate rolls by using a coolant shielding member arranged at a position adjacent to the work rolls.

(22) Further, in order to achieve the above second object, according to the present invention, provided is a rolling method of rolling a plate, using a rolling mill provided with a pair of work rolls, a pair of intermediate rolls supporting the pair of work rolls, respectively and a pair of backup rolls supporting the pair of intermediate rolls, respectively, in mill stands, wherein the method comprises the steps of: arranging the pair of backup rolls so that the axial lines of the pair of backup rolls do not incline to each other in a horizontal plane, arranging the intermediate rolls and work rolls so that each of the axial lines of the intermediate rolls and work rolls can incline, contrarily to each other, to the axial lines of the backup rolls in a horizontal plane, rolling a plate while supplying a lubricant to the roll surfaces of the work rolls, intermediate rolls and backup rolls, and measuring thrust force of the work rolls in an axial direction, comparing a measured value of thrust force with a value set in advance to calculate a difference therebetween, changing the cross angle of the work rolls according the difference, and changing the cross angle of the intermediate rolls according to a changed value of cross angle of the work rolls.

(23) In the above-mentioned item (22), preferably, when the measured value of thrust force is larger than the set value from the thrust force setting unit, the cross angle of the work rolls is changed so that the difference becomes small, and the cross angle of the intermediate rolls is changed so as to cancel a change amount in thickness distribution of the plate due to the change amount of the cross angle of the work rolls.

(24) Further, in the above-mentioned item (22), preferably, in a case where an angle of each work roll to a direction perpendicular to a rolling direction of the plate is defined as a cross angle of work roll and an angle of each intermediate roll to a direction perpendicular to a rolling direction of the plate is defined as a cross angle of intermediate roll, the changing of the cross angle of the work rolls is effected in a range in which the cross angle of the work roll is 0.2 degrees or more, and the changing of cross angle of the intermediate rolls is effected in a range in which the cross angle of the intermediate roll is 0.1 degrees or more in a counter direction to the work roll.

(B) operation and principle of the present invention:

The operation and principle of the present invention employing the above-mentioned solving means are as follows:

As mentioned previously, any of the roll crossing type of rolling mills which have successfully been put into practice are 4-high mills and there is no example of a 6-high mill which was successfully put into practice. In the 4-high mills, since the work rolls are driven, large diameter rolls are used therefor. However, small diameter rolls are suitable for rolling hard plates and thin plates, and in such a case, 6-high mills are used in many cases.

Results of the study conducted by the inventors of the present application are as follows. Occurrence mechanisms of thrust force differ between in a case where intermediate rolls cross in 6-high mills and in a case where work rolls cross in 4-high mills. In the conventional 6-high mills, it is found that there is the probability that excessively large thrust force occurs in the rolls during rolling and it becomes impossible to continue the rolling. This is explained hereunder, referring to FIGS. 1 to 7.

4-High Mill

Comparative Example 1

FIG. 1 is a view of a roll arrangement of a 4-high mill for explaining an occurrence mechanism of thrust force when only work rolls are arranged to cross. When a plate 101 is rolled with the work rolls 102 arranged to cross, a relative slip of a velocity difference $\Delta V_{WS}$ occurs at a contact surface between each work roll 102 (velocity $V_W$) and the plate 101 (velocity $V_S$), and a relative slip of a velocity difference $\Delta V_{WB}$ occurs at a contact surface between each work roll 102 and each backup roll 104 (velocity $V_B$). As the resistance to the relative slip, thrust force $F_{WS}$ occurs at the contact surface between the work roll 102 and the plate 101, and thrust force $F_{WB}$ occurs at the contact surface between the work roll 102 and the backup roll 104. As in FIG. 1, since $F_{WS}$ and $F_{WB}$ always act in a counter direction to each other in a case where only the work rolls 102 cross, the thrust force of the work roll 102 is necessarily smaller than that of the backup roll 104. That is, the thrust force of the backup roll 104 is $F_{WB}$, and the thrust force of the work roll is $F_{WS}-F_{WB}$.

FIG. 2 shows an example of characteristics of the thrust force occurring between the work roll and the backup roll in a case where the work rolls of the 4-high mill cross. In FIG. 2, $\mu$ in the ordinate expresses values (called as thrust coefficient) each of which is a value obtained by dividing the occurred thrust force in the roll axis direction by the rolling load, and abscissa expresses cross angles of one work roll to a line perpendicular to the rolling direction. The thrust forces take different values according to various conditions. Thrust coefficient is expressed by $\mu$W in the case of water lubrication, and $\mu$e in the case of lubrication with emulsion in which oil is mixed in water. Thrust force $\mu$p between the plate and the work roll is expressed in FIG. 2 for comparison.

In FIG. 2, the thrust coefficient $\mu$W in the case of water lubrication reaches about 30%. Usual chocks are short in strength for bearing such excessive thrust force, and the thrust force becomes a cause of rupture of the chocks. Further, chocks which are able to support such excessively large thrust force become huge in size and cause such a disadvantage that the equipment becomes large in size.

On the other hand, in a case where lubrication between rolls (inter-roll lubrication) is effected using emulsion, since the thrust coefficient $\mu$e can be suppressed to about 8%, the thrust force can be sufficiently supported by the usual chocks.

Further, in a case where inter-roll lubrication is employed, the thrust coefficient $\mu$e rapidly increases to 0–6% in a cross angle range of about 0.0–0.1 degrees, and gradually increases to 6–8% in a cross angle range of about 0.1–1.2 degrees. On the other hand, the thrust coefficient $\mu$p between the plate and the work roll is proportional to change in the cross angle, and the thrust coefficient becomes 0.0–10% in a cross angle range of about 0.0–1.2 degrees.

From the above-mentioned, in the 4-high mill in FIG. 1, by supplying lubricant between the rolls as disclosed in JP A 5-50110, the thrust force $F_{WB}$ of the backup roll 104 can be suppressed to about 8% of the rolling load, and the thrust force $F_{WS}-F_{WB}$ of the work roll 102 can be suppressed to about 4% or less of the rolling load by setting the cross angle θw of the work roll 102 to an angle in a suitable range of 0.1 degrees or more. The backup roll is usually about 1,500 mm in diameter, backup roll chocks and bearings also are sufficiently large in size, so that they can bear sufficiently the thrust force of about 8% of the load. In this time, even if the diameter of the work roll 102 is made small to be about 800 mm, the thrust force also becomes small according thereto, so that the work roll 102 can bear sufficiently the thrust force.

In this manner, in the 4-high mill, in a case where only the work rolls are arranged to cross, the thrust force which the work roll receives from the plate and the thrust force which the work roll receives from the backup roll are necessarily counter to each other, so that the thrust force of the work roll becomes necessarily smaller than the thrust force of the backup roll, further, thrust force value also can be kept small by supplying lubricant between rolls.

6-High Mill

Comparative Example 2

In a case where the intermediate rolls are arranged to cross a line perpendicular to the rolling direction in a 6-high mill, thrust force can not be decreased simply as in the 4-high mill.

FIG. 3 shows an example of prior arts as disclosed in JP B 50-24903 and JP B 52-1701, for explaining a thrust force occurrence mechanism in a case where a plate 201 is rolled in a 6-high mill, with only the intermediate rolls arranged to cross. When the plate is rolled with the intermediate rolls 203 (velocity $V_I$) arranged to cross, a relative slip of velocity difference $\Delta V_{IB}$ occurs at a contact surface between each intermediate roll 203 and each backup roll 204 (velocity $V_B$), and a relative slip of velocity difference $\Delta V_{WI}$ occurs at a contact surface between each work roll 202 (velocity $V_W$) and the intermediate roll 203. As the resistance against those slips, thrust force $F_{IB}$ occurs at the contact surface between the intermediate roll 203 and the backup roll 204, and thrust force $F_{WI}$ occurs at the contact surface between the work roll 202 and the intermediate roll 203. From FIG. 3, in the case of only the intermediate roll 203 arranged to cross, since $F_{WI}$ and $F_{IB}$ act necessarily in a counter direction to each other, the thrust forces acting on the intermediate roll 203 are cancelled to become small force. Therefore, the thrust force of the backup roll 204 becomes $F_{IB}$, the thrust force of the intermediate roll 203 becomes $F_{WI}-F_{IB}$ and the thrust force of the work roll 202 becomes $-F_{WI}$.

Here, in the prior art, since lubricant is not supplied between the rolls, the thrust force between the rolls reaches 30% or more of the load and becomes a large value (refer to $\mu$w in FIG. 2). That is, the thrust force $F_{IS}$ of the backup roll 204 and the thrust force $F_{WI}$ of the work roll 202 become excessively large, there is no means for bearing the excessively large thrust force, and it is difficult to put into practice.

Further, if lubricant is supplied between the rolls, since the thrust force between the rolls can be suppressed to about 8% of the load (refer to $\mu$e in FIG. 2), the thrust forces $F_{IS}$, $-F_{WI}$ of the backup roll 204 and work roll 202 each become about 8% of the load. The backup roll 204 has usually diameter of about 1,400 mm, and the backup roll chocks and bearings also are sufficiently large, so that they can bear sufficiently thrust force of about 8% of the load. However, the thrust force of the work roll 202 also is 8%, and in a case where the diameter of the work roll 202 is made small to be about 600 mm, the work roll chocks and bearings also become small, so that they can not bear the above-mentioned thrust force. Finally, it becomes impossible to make small the diameter of the work roll 202, work rolls of large diameter cannot but be used. Use of work rolls of large diameter brings about such a problem that equipment becomes large in size and the production cost increases. Further, since an area of the work roll contacting with the plate increases by using work rolls of large diameter, a contact surface pressure decreases and sufficient reduction becomes impossible, and an unfavorable problem of productivity such that rolling efficiency decreases occurs.

6-High Mill

Comparative Example 3

FIG. 4 shows an example of the prior art disclosed in JP A 61-279303 to explain a thrust force occurrence mechanism in a case where each intermediate roll and work roll are arranged to cross as one unit in a 6-high mill.

When the plate is rolled, with the intermediate roll 303 (velocity $V_I$) and each work roll 302 (velocity $V_W$) crossing as one unit, a relative slip of velocity difference $\Delta V_{IB}$ occurs at a contact surface between the intermediate roll 303 and backup roll 304 (velocity $V_B$), and a relative slip of velocity difference $\Delta V_{WB}$ occurs at a contact surface between work roll 302 and the plate 301. As the resistance against those thrust forces, thrust force $F_{IB}$ occurs at the contact surface between the intermediate roll 303 and the backup roll 304, and a thrust force $F_{WS}$ occurs at the contact surface between the work roll 302 and the plate. Therefore, the thrust force of the backup roll 304 becomes $F_{IB}$, the thrust force of the intermediate roll 303 becomes $-F_{IB}$ and the thrust force of the work roll 302 becomes $F_{WS}$.

Here, in the prior art, since any lubricant is not supplied between the rolls, the thrust force between the rolls reaches 30% or more of the load, which is a large value. That is, the thrust force $F_{IB}$ of the backup roll 304 and the thrust force $-F_{IB}$ of the intermediate roll 303 become excessively large, and there is no means for bearing such an excessively large thrust force, whereby it is difficult to put into practice.

Further, if lubricant is supplied between the rolls, since the thrust force between the rolls can be suppressed to about 8% of the load, the thrust forces $F_{IB}$ and $-F_{IB}$ of the backup roll 304 and intermediate roll 303 each become about 8% of the load, and the thrust force of the work roll 302 becomes about several % although it has a different value depending on the cross angle θw. The backup roll 304 has usually diameter of about 1,400 mm, and backup roll chocks and bearings also are sufficiently large, so that they can bear sufficiently a thrust force of about 8% of the load. However, the thrust force of the intermediate roll 303 also is 8% of the load, and in a case where the diameter of the intermediate roll 303 is made small to be about 800 mm, the roll chocks and bearings also become small, so that they can not bear the thrust force as mentioned above. Finally, it becomes impossible to make small the diameter of the intermediate roll 303, and intermediate rolls of large diameter cannot but be used. Use of intermediate rolls of large diameter brings about such an unfavorable problem that equipment including an apparatus for crossing the rolls becomes large-sized and a production cost increases.

6-High Mill

Comparative Example 4

FIG. 5 shows another example of the prior arts disclosed in JP A 61-279305 to explain a thrust force occurrence mechanism in a case where each backup roll and intermediate roll are arranged to cross as one unit in a 6-high mill.

When the plate is rolled by arranging each intermediate roll 403 (velocity $V_I$) and each backup roll 402 (velocity $V_B$) to cross as one unit, a relative slip of velocity difference $\Delta V_{WI}$ occurs at a contact surface between the intermediate roll 403 and work roll 402 (velocity $V_W$). As the resistance against this thrust force, thrust force $F_{WI}$ occurs at the contact surface between the intermediate roll 403 and the work roll 402. Therefore, the thrust force of the intermediate roll 403 becomes $F_{WI}$ and the thrust force of the work roll 402 becomes $F_{WI}$.

Here, in the prior art, since any lubricant is not supplied between the rolls, the thrust force between the rolls reaches 30% or more of the load, which is a large value. That is, the thrust force $F_{WI}$ of the intermediate roll 403 and the thrust force $F_{WI}$ of the work roll 402 become excessively large, and there is no means for bearing such an excessively large thrust force, whereby it is difficult to put into practice.

Further, if lubricant is supplied between the rolls, since the thrust force between the rolls can be suppressed to about 8% of the load, the thrust forces $F_{WI}$ and $F_{WI}$ of the work roll 402 and intermediate roll 403 each become about 8% of the load, however, when any of them are made in small in diameter, since the roll chocks and bearings also becomes small, so that they can not bear the thrust force. Finally, it becomes impossible to make small the diameter of the work roll and intermediate roll, and the work roll and intermediate rolls of large diameter cannot but be used. Use of rolls of large diameter brings about such an unfavorable problem that the equipment becomes large-sized and a production cost increases. Further, since an area of the work roll contacting with the plate increases by using work rolls of large diameter, a contact surface pressure decreases and sufficient reduction becomes impossible, and an unfavorable problem of productivity such that the rolling efficiency decreases occurs.

6-High Mill

Comparative Example 5

FIG. 6 is a view for explaining a thrust force occurrence mechanism in a case where only work rolls are crossed in a 6-high mill. When rolling is effected with only the work rolls 502 are arranged to cross, a relative slip of velocity difference $\Delta V_{WS}$ occurs at a contact surface between the work roll 503 (velocity $V_W$) and a plate 501 (velocity $V_S$), and a relative slip of velocity difference $\Delta V_{WI}$ occurs at a contact surface between the work roll 502 (velocity $V_W$) and the intermediate roll 503 (velocity $V_I$). As the resistance against those relative slips, thrust force $F_{WS}$ occurs at the contact surface between the work roll 503 and the plate 501, and thrust force $F_{WI}$ occurs at the contact surface between the work roll 502 and the intermediate roll 503. From FIG. 6, in the case of only the work rolls 502 crossing, since $F_{WS}$ and $F_{WI}$ act necessarily in a counter direction to each other, the thrust force of the work roll 502 becomes necessarily smaller than the thrust force of the intermediate roll 503. That is, the thrust force of the intermediate roll 503 becomes $F_{WI}$ and the thrust force of the work roll 502 becomes $F_{WS}-F_{WI}$.

Here, in the case of no lubricant being supplied between rolls, since the thrust force between the rolls reaches 30% or more of the load and becomes a large value, the thrust force $F_{WI}$ of the intermediate roll 503 and the thrust force $F_{WS}-F_{WI}$ of the work roll 502 become excessively large, there is no means for bearing the excessively large thrust force, and it is difficult to put into practice.

Further, if lubricant is supplied between the rolls, since the thrust force between the rolls can be suppressed to about 8% of the load, the thrust force $F_{WS}-F_{WI}$ of the work roll 502 can be made about 4% or less of the load by setting the cross angle θw of the work roll 502 in a suitable range of 0.1 degrees or more. On the other hand, the thrust force $F_{WI}$ of the intermediate roll 503 is about 8% of the load, and when the roll diameter is made small, the roll chocks and bearings also become small, so that they can not bear the thrust force. Finally, it becomes impossible to make small the diameter of the intermediate rolls 502 and the intermediate rolls of large diameter cannot but be used. Use of the rolls of large diameter bring about such an undesirable problem that the equipment becomes large in size and a production cost increases.

6-High Mill

Comparative Example 6

FIG. 7 shows an example of the prior art disclosed in JP A 6-31304 to explain a thrust force occurrence mechanism in a 6-high mill in a case where intermediate rolls and work rolls are arranged to cross so that their axes incline, in an opposite direction to each other, the axis of backup rolls. When a plate is rolled, with intermediate rolls 603 (velocity $V_I$) and work rolls 602 (velocity $V_W$) crossing in opposite directions to each other, a relative slip of velocity difference $\Delta V_{IB}$ occurs at a contact surface between the intermediate roll 603 and backup roll 604 (velocity $V_B$), a relative slip of velocity difference $\Delta V_{WI}$ occurs at a contact surface between the work roll 602 and intermediate roll 603, and a relative slip of velocity difference $\Delta V_{WS}$ occurs at a contact surface between the work roll 602 and the plate 601. As the resistance against those relative slips, thrust force $F_{IB}$ occurs at the contact surface between the intermediate roll 603 and the backup roll 604, thrust force $F_{WI}$ occurs at the contact surface between the work roll 602 and the intermediate roll 603 and thrust force $F_{WS}$ occurs at the contact surface between the work roll 602 and the plate 601. From FIG. 7, in a case where the intermediate roll 603 and the work roll 602 cross the axis of the backup roll 604 in opposite directions, $F_{WI}$ and $F_{IS}$ occurred on the intermediate roll 603 act necessarily in an opposite direction and $F_{WI}$ and $F_{IS}$ occurred on the work roil 602 act necessarily in an opposite direction, so that the thrust force of the backup roll 604 becomes $F_{IB}$, the thrust force of the intermediate roll 603 becomes $F_{WI}-F_{IB}$ and the thrust force of the work roll 602 becomes $F_{WS}-F_{WI}$.

Here, in the prior art, since any lubricant is not supplied between the rolls, the thrust force between the rolls reaches 30% or more of the load and becomes a large value, the thrust force $F_{WS}-F_{WI}$ of the work roll 602 becomes excessively large, there is no means for bearing such an excessively large thrust force, and it is difficult to put into practice.

Further, in JP A 6-31304, shape control is effected by changing a cross angle of the work roll in a 6-high mill, and the thrust force occurred on the work roll is measured and the intermediate roll is arranged to cross in an opposite direction so as to cancel the thrust force. Therefore, even if lubricant is supplied between the rolls, there are the following problems:

As has been explained referring to FIG. 2, in a case where lubrication between rolls is effected, the thrust coefficient $\mu e$ between rolls rapidly increases to 0–6% in a cross angle range of about 0.0–0.1 degrees, and gradually increases to 6–8% in a cross angle range of about 0.1–1.2 degrees. On the other hand, the thrust coefficient $\mu p$ between the plate and the work roll is proportional to a change in the cross angle, and the thrust coefficient becomes 0–10% in a cross angle range of about 0.0–1.2 degrees.

In a case where plate crown changed during rolling from one cause or another, it is possible to correct the plate crown by changing the cross angle of the work roll as in JP A 6-31304. However, since the thrust force between the plate and the work roll changes largely in proportion to the cross angle as mentioned above (a thrust coefficient changes by 0.83% per a cross angle change of 0.1 degrees), mill center moment acting on the rolling stand changes by a change in the thrust force occurring on the upper lower work roll.

In general, a rolling mill has load detectors mounted thereon for detecting left and right loads, when a difference between the left and right loads detected by the load detectors exceeds an allowable range, a screw down apparatus is driven so as to balance the left and right loads, thereby controlling the thickness of a plate to be symmetric on left and right sides of the plate. When the mill center moment changes by a change in thrust force as mentioned above, irrespective of that the left and right loads also change, a difference between the left and right loads is measured, and the rolling is effected to be symmetric on the left and sides, the rolled plate is acknowledged to be asymmetric by error and it becomes a cause for erroneous correction.

Further, in the case of making small the diameter of work roll, since the thrust force applied on the work roll is made small by cancelling thrust force between rolls and thrust force between the plate and roll, it is necessary to set a cross angle of the work roll to about 0.2 degrees or more (it will be described later). In this case, a cross angle between the work roll and intermediate roll becomes 0.2 degrees or more.

Under this condition, in a case where the thrust force of the work roll increased from one cause or another, even if the thrust force is measured and it is tried to cancel an increment of the thrust force by an increase of the thrust force between the rolls, caused by changing the cross angle of the intermediate roll, as disclosed in JP 6-31304, a change in the thrust force between the intermediate roll and work roll is small in a range of cross angle of 0.2 degrees or more (a thrust coefficient per a cross angle change of 0.1 degrees is a change of 0.18%), it is difficult to decrease the thrust force. Finally, it is impossible to make small the diameter of work roll and work rolls of large diameter are to be used. Use of work rolls of large diameter brings about such a problem that the equipment becomes large in size and the production cost increases. Further, since an area of the work roll contacting with the plate increases by using work rolls of large diameter, a contact surface pressure decreases and sufficient reduction becomes impossible, and an unfavorable problem of productivity such that rolling efficiency decreases occurs.

As mentioned above, in the conventional 6-high mills, since a sufficient consideration is not taken concerning the axial thrust force caused by a crossing arrangement of the rolling rolls, excessively large thrust force occurs on rolls during rolling, it is impossible to take care of an unexpected increase of the thrust force, and a problem of strength and a problem concerning stable rolling occur, whereby the mills have been not put into practice, as yet.

6-High Mill (Concept Relating to the First Object of the Invention)

Contrary to the prior arts as mentioned above, the present invention provides the 6-high mill of the comparative example 6 with a lubrication supplying apparatus for supplying lubricant on the roll surfaces and effects inter-roll lubrication. Such inter-roll lubrication can suppress the thrust force between the rolls to about 8% of the load, as explained referring to FIG. 2, therefore, by setting a cross angle $\theta w$ of the work roll 602 and a cross angle $\theta_I$ of the intermediate roll 603 in a suitable range, it is possible to reduce the thrust force $F_{WI}-F_{IB}$ of the intermediate roll 603 to an extent in which no problem occurs and it is possible to reduce the thrust force $F_{WS}-F_{WI}$ of the work roll 602 to about 5% or less of the load.

That is, in the present invention, taking into consideration the above-mentioned thrust coefficient change characteristics, a cross angle of the work roll is set so that the thrust force occurring on the work roll does not become excessively large, and taking into consideration the cross angle of the work roll, the cross angle of the intermediate roll is set so that the plate will be rolled to be a desired thickness distribution. More concretely, the cross angle of the work roll is set to 0.2 degrees or more, and the cross angle of the intermediate roll is set to 0.1 degrees or more in opposite directions to the work roll.

In the case of making small the diameter of the work roll, since the thrust force acting on the work roll is made small by cancelling the thrust force between the rolls and the thrust force of the plate, it is necessary to set the cross angle of the work roll to about 0.2 degrees or more, which has been described previously. This is for the following reasons:

In a range in which the cross angle of the work roll is 0.2 degrees or more, the thrust coefficient between the work roll and the plate is 2% or more. In this case, a cross angle of the intermediate roll across the work roll becomes 0.2 degrees or more, so that the thrust coefficient between the intermediate roll and the work roll becomes 7–8%. Therefore, the thrust force of the work roll $F_{WS}-F_{WI}$ becomes about 5% or less of the load.

Therefore, by setting the cross angle of the work roll to be 0.2 degrees or more, the thrust force $F_{WS}-F_{WI}$ of the work roll 602 can be reduced to 5% or less of the load.

On the other hand, as for the intermediate roll, the intermediate roll is in roll contact with the backup roll and work roll. Here, in a case where lubrication between rolls is employed, a thrust coefficient $\mu e$ of the roll contact slightly increases to be 6–8% in a range of cross angle of 0.1 degrees or more. Further, in a case where the intermediate roll crosses the work roll in an opposite direction, by setting the cross angle of the intermediate roll to 0.1 degrees or more, a cross angle between the work roll and intermediate roll becomes necessarily 0.1 degrees or more, and in the case of setting the work roll cross angle to 0.2 degrees or more as mentioned above, a cross angle between the work roll and intermediate roll becomes 0.3 degrees or more. Therefore, by setting the cross angle of the intermediate roll to about 0.1 degrees or more, a thrust coefficient for the intermediate roll and a thrust coefficient are substantially the same value as each other, the thrust forces at the contact surface of the intermediate roll and work roll are cancelled with respect to each other, and the thrust force of the intermediate roll 603 can be reduced to a small value of the extent that any problem does not occur.

Further, in a range of cross angle of 0.1 degrees or more, a change in thrust coefficient between rolls is small, so that the thrust force at the work roll is almost changed even if the cross angle of the intermediate roll is set to any value in the cross angle range of 0.1 degrees or more, and it is possible to adjust the thickness distribution of a plate by setting the cross angle to an optimum value, taking into consideration the cross angle of the work roll.

From the above, in the present invention, by a 6-high mill in which the intermediate rolls and work rolls are arranged to cross, it is possible to suppress occurrence of an excessively large thrust force accompanied by the roll-crossing and to produce by stably rolling excellent plates, and it is possible to produce plates of excellent quality without causing any disadvantage such that the thickness distribution is worsened due to roll-crossing limited by an increase in the thrust force and the quality of plates is worsened.

6-High Mill (Concept Relating to the Second Object of the Invention)

Further, in the present invention, in a case where the thrust force of the work roll increased during rolling from one cause or another, the thrust force is decreased by changing the cross angle of the work roll, and the cross angle of the intermediate roll is changed according to the change amount of the cross angle of the work roll. Further, the cross angle of the work roll is changed in the range in which the cross angle of the work roll is 0.2 degrees or more, and the cross angle of the intermediate roll is changed in a range in which the cross angle of the intermediate roll becomes 0.1 degrees or more in an opposite direction to the work roll.

As mentioned previously, in the case of inter-roll lubrication, inter-roll thrust coefficient is small in a range of cross angle of 0.1 degrees or more (a change in thrust coefficient is 0.18% per 0.1 degrees of cross angle change), even if plate crown is corrected by changing the cross angle of the intermediate roll, an influence thereof on the thrust force is small, a difference between left and right loads caused in the mill is small, so that it is unlikely to be a cause of erroneous correction of the shape of plate. Accordingly, even if a thickness distribution (plate crown or plate shape) changes by changing the cross angle of the work roll during rolling by passing through a plate, the thickness distribution can be easily changed by crossing of the intermediate roll.

DESCRIPTION OF EMBODIMENTS OF THE INVENTION

Figure 8:
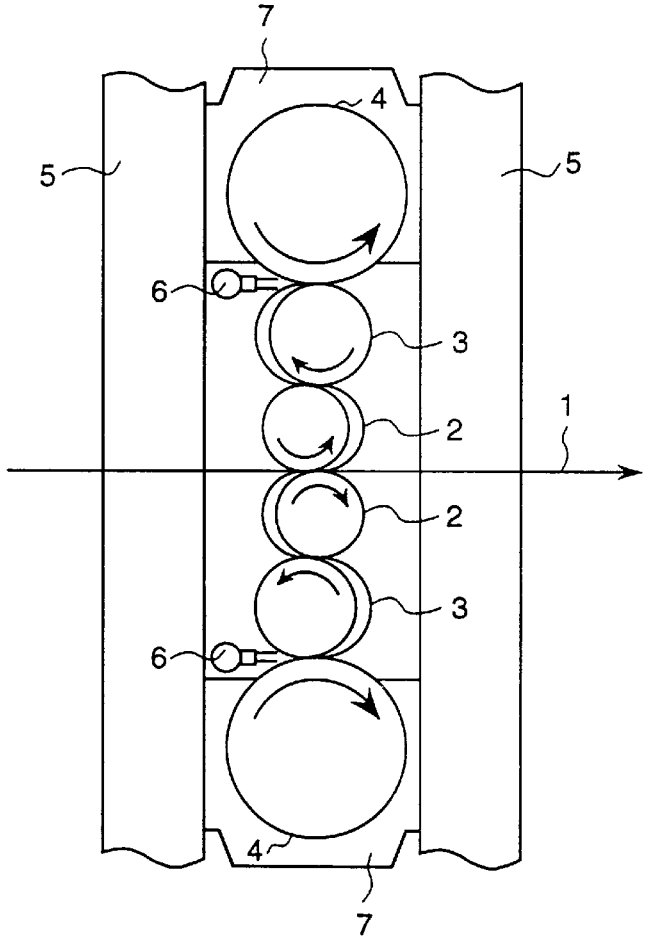
FIG. 8 is a view of a roll arrangement of a 6-high mill of a first embodiment of the present invention, in which the intermediate rolls and work rolls are arranged to cross the axis of the backup rolls so that the axes of the intermediate rolls and the axes of the work rolls incline in opposite direction to each other.
Figure 9:
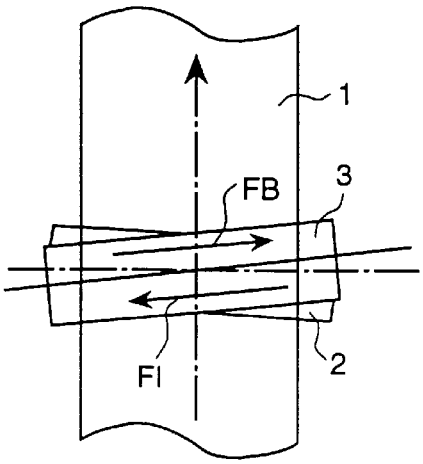
FIG. 9 is a view explanatorily showing a relation between the intermediate roll and the thrust force imparted to the intermediate roll.
Figure 10:
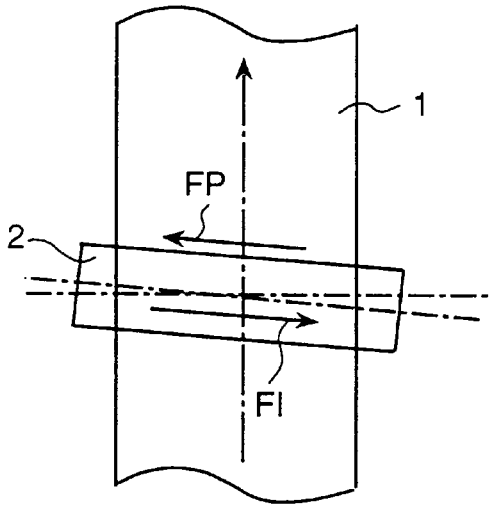
FIG. 10 is a view explanatorily showing a relation between the work roll and the thrust force imparted to the work roll.

A first embodiment of the invention is described hereunder, referring to FIGS. 8–10.

FIG. 8 is a view showing a 6-high mill of the present embodiment, FIG. 9 is a view explanatorily showing a relation between an intermediate roll and the thrust force imparted to the intermediate roll, and FIG. 10 is a view explanatorily showing a relation between a work roll and the thrust force imparted to the work roll.

As shown in FIG. 8, the 6-high mill according to the present invention has a pair of work rolls 2, a pair of intermediate rolls 3 and a pair of backup rolls 4, each mounted on a mill stand 5. The backup rolls 4 each are arranged so that the axis crosses perpendicularly a travelling direction of a plate 1 and does not incline to an imaginary line perpendicular to the travelling direction in a horizontal plane. The intermediate roll 3 and work roll 2 are arranged so that their axes incline against (cross) the axis of the backup roll 4 in opposite directions to each other, respectively. Further, lubricant supplying apparatus 6 are provided for supplying the surfaces of the rolls.

The lubricant supplying apparatus 6 is mounted to supply lubricant between the backup roll 4 and intermediate roll 3 (for inter-roll lubrication). The lubricant supplied by the lubricant supplying apparatus 6 is adhered to roll surfaces through contact portions of the rolls because the intermediate roll 3 is in contact with the backup roll 4 and work roll 2.

Further, the cross angle of the work roll 2 is set in a range of about 0.2 degrees or more, preferably, 0.3–1.5 degrees, the cross angle of the intermediate roll 3 is set in a range of about 0.1 degrees or more (a cross angle between the roll 3 and the work roll 2 is 0.3 degrees or more), preferably, 0.3–1.2 degrees.

In the present embodiment with the above-mentioned construction, since a lubricant is supplied to the roll surfaces of the work roll 2 and intermediate roll 3, the thrust force on a contact surface of the backup roll 4 and the intermediate roll 3 and the thrust force on a contact surface of the intermediate roll 3 and work roll 2 each are decreased to about 8% of the load.

The backup roll 4 is large in diameter and supported by a large sized chock 7, and can bear sufficiently the thrust force of about 8% of the load.

Further, as shown in FIG. 9, the intermediate roll 3 is in contact with the backup roll 4 and receives thrust force FB, and the intermediate roll 3 also receives, from the work roll 2, thrust force FI in an opposite direction to the thrust force FB because the intermediate roll 3 crosses the work roll 2. Therefore, although the intermediate roll 3 is smaller in diameter than the backup roll 4 and the roll chock therefor also is smaller, the thrust forces at the contact surfaces of the backup roll 4 and intermediate roll 3 are nearly equal to each other and they are opposite forces, so that the two thrust forces are canalled with respect to each other to be a thrust force FB–FI in total, which force is small to the extent that it is not problematic.

Further, as shown in FIG. 10, the work roll 2 is in contact with the intermediate roll 3 and receives thrust force FI, however, since the work roll 2 crosses in the opposite direction to the intermediate roll 3, the work roll 2 receives the thrust force FP in an opposite direction to FI, so that total thrust force FI–FP becomes further smaller than about 8% of the above-mentioned load.

That is, as mentioned above, the study by the inventors made it clear that the thrust force caused by contact between inclined rolls and the thrust force caused by contact of a plate and an inclined roll are different in state of thrust force occurrence. When an inclination angle of one roll against a direction perpendicular to a rolling direction in a horizontal plane is defined as a cross angle, in a case where an inclined roll is in contact with an inclined roll, the thrust force increases as the cross angle increases, however, when the cross angle reaches to about 0.2–0.4 degrees, the thrust force is saturated to a value of about 8% of the load, and even if the cross angle becomes much larger than that cross angle, the thrust force increases little. In the case of contact between a plate and an inclined roll, as the cross angle increases, the thrust force increases linearly proportionally thereto, and the thrust force becomes about 8% of the load at an cross angle of about 0.8–1.0 degrees.

In this embodiment, the cross angle of the work roll 2 is set to about 0.3–1.5 degrees, and a range of the cross angle of the intermediate roll 3 is set to about 0.3–1.2 degrees. Thereby, thrust coefficients of the work roll and intermediate roll each can be made 0.5% or less. A control ability of plate crown in this case corresponds to a cross angle of about 0.3–2.2 degrees which is a cross angle in the case of only the work roll being crossed, and it becomes a very large control range, whereby the plate crown control ability increases greatly.

According to this embodiment as mentioned above, since both the intermediate roll 3 and work roll 2 are arranged so that their axes cross the axis of the backup roll 4 in a counter direction to each other and a lubricant is supplied from the lubricant supplying apparatus 6 onto the roll surfaces, such thrust force occurrence that becomes a problem when rolling is effected by arranging the intermediate roll and the work roll each to cross can be suppressed and it is possible to roll stably and produce excellent plates. Further, uniform thickness distribution can be secured and plates of excellent quality can be produced without occurrence of such disadvantages that the thickness distribution becomes ununiform and the quality of the plates is worsened by restricting the roll crossing due to occurrence of excessively large thrust force.

Figure 11:
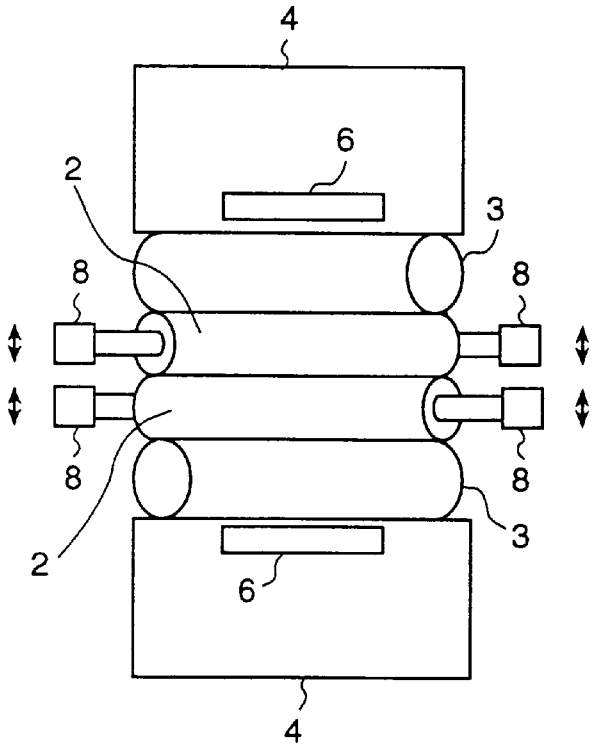
FIG. 11 is a view of a roll arrangement of a 6-high mill of a second embodiment of the present invention.

Next, a second embodiment of the present invention is described, referring to FIG. 11. In FIG. 11, a plate to be rolled is omitted and the same reference numbers are given to parts equivalent to those in FIG. 8.

As shown in FIG. 11, backup rolls 4 are arranged so that their axes cross a direction perpendicular to a travelling direction of a plate and do not incline against the direction perpendicular to the plate travelling direction in a horizontal plane. An intermediate roll 3 and a work roll on an upper side of a rolling path are arranged so that their axes incline against (cross) the axis of the backup roll 4 in opposite directions to each other. The work roll 2 has roll benders 8 mounted on both ends for imparting roll bending force thereon. Lubricant supplying apparatus 6 is provided for supplying lubricant on the roll surfaces. Intermediate roll and work roll on a lower side of the rolling path have the same construction as on the upper side, however, the inclination directions of the intermediate roll and the work roll on the upper side are opposite to the inclination directions of those on the lower side.

In this embodiment also, since the intermediate rolls 3 and the work rolls 2 cross in the opposite directions and lubrication is employed, the same effect as in the first embodiment can be attained.

Further, according to the present embodiment, a load from the backup roll 4 on portions of the work roll 2 which are not in contact with the plate can be reduced by crossing the intermediate roll 3, so that a bending effect of the work roll 2 increases as compared with that in a case where the intermediate roll 3 does not cross. Therefore, by jointly using the work roll benders 8, it is possible to correct undesirable thickness distribution of plate end portions called as edge drop. Further, by using hydraulic benders as the work roll benders 8, correction of thickness distribution in the plate width direction is possible in a short time even during rolling, a more uniform thickness distribution can be secured, and plates of excellent quality can be produced.

In the embodiment shown in FIG. 11, although general roll benders 8 are used for imparting bending force in a perpendicular direction, it is possible to use work roll benders each imparting bending force in a horizontal direction, utilizing that the work roll is small in diameter.

Figure 1:
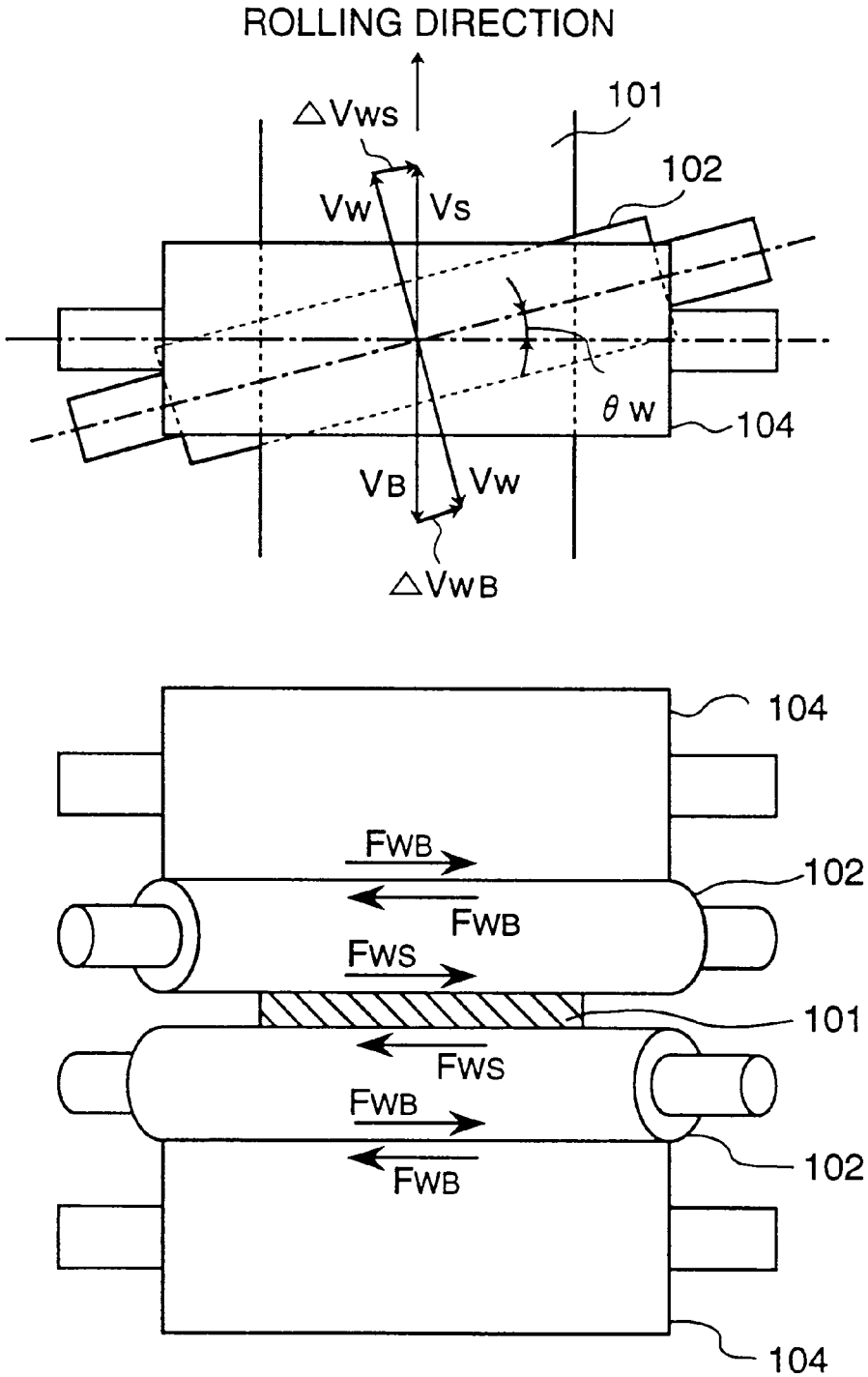
FIG. 1 is a view of a roll arrangement of a 4-high mill for explaining a thrust occurrence mechanism in a case where only the work rolls are arranged to cross.
Figure 2:
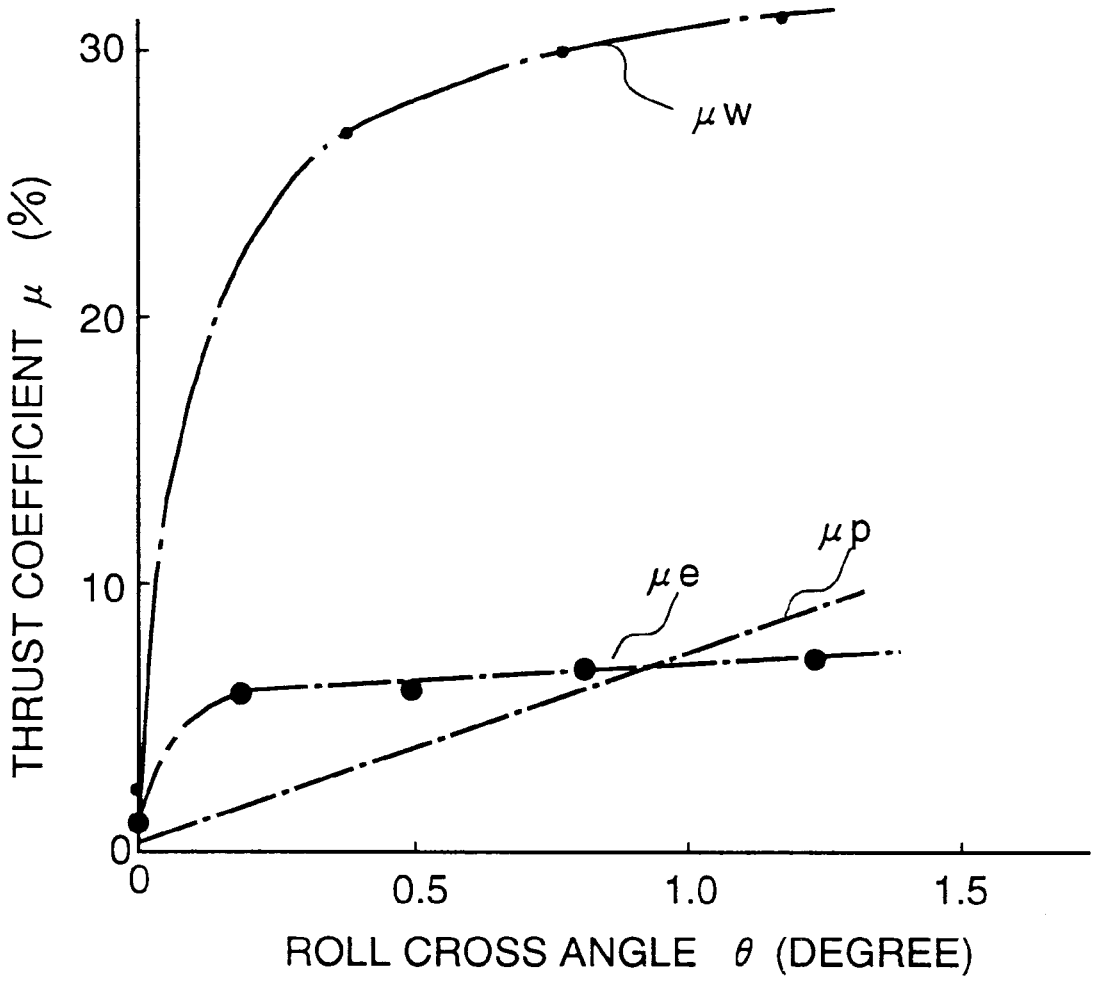
FIG. 2 is a graph showing characteristic coefficient of thrust forces loaded on the work roll as a function of roll cross angles and supplied lubricant.
Figure 3:
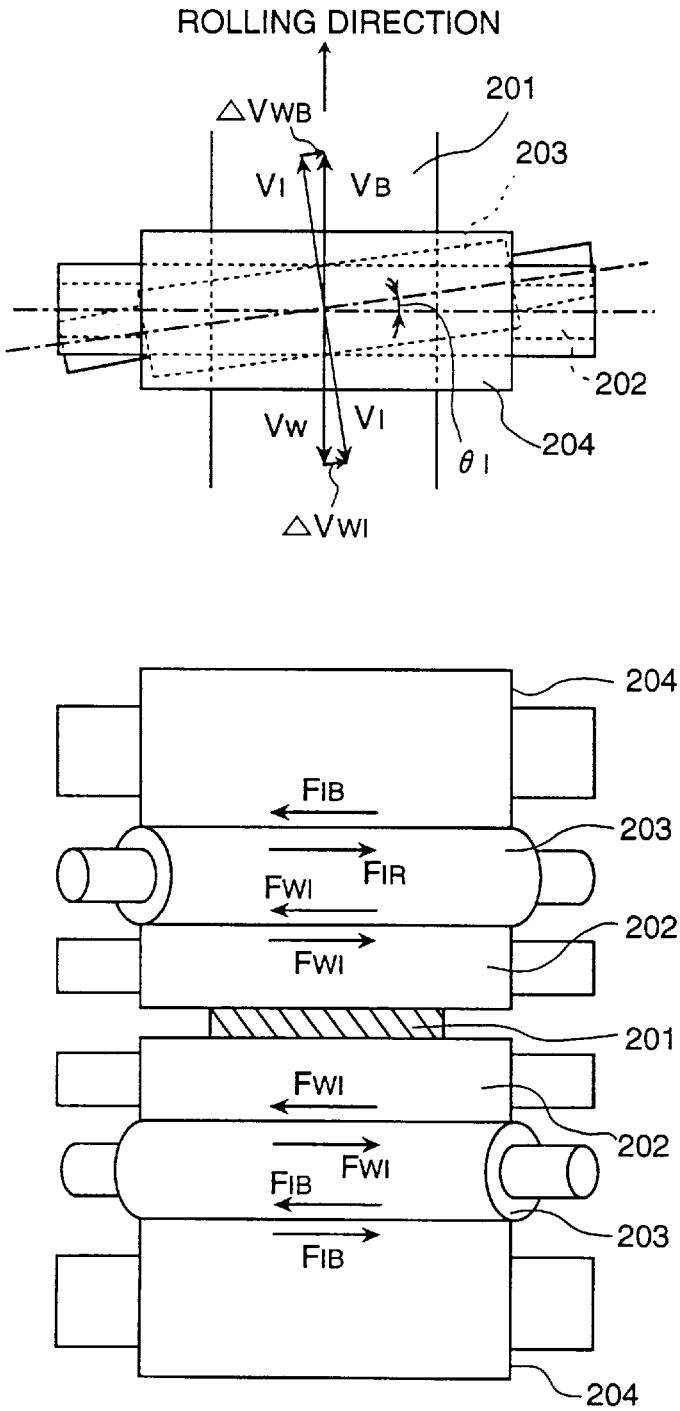
FIG. 3 is a view of a roll arrangement of a 6-high mill for explaining a thrust occurrence mechanism in a case where only the intermediate rolls are arranged to cross and a plate is rolled.
Figure 4:
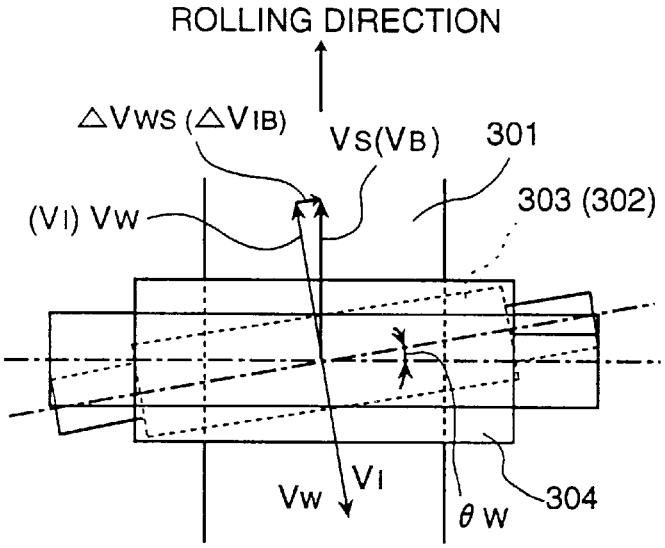
FIG. 4 is a view of a roll arrangement of a 6-high mill for explaining a thrust occurrence mechanism in a case where the intermediate rolls and work rolls are arranged to cross as one unit.
Figure 4:
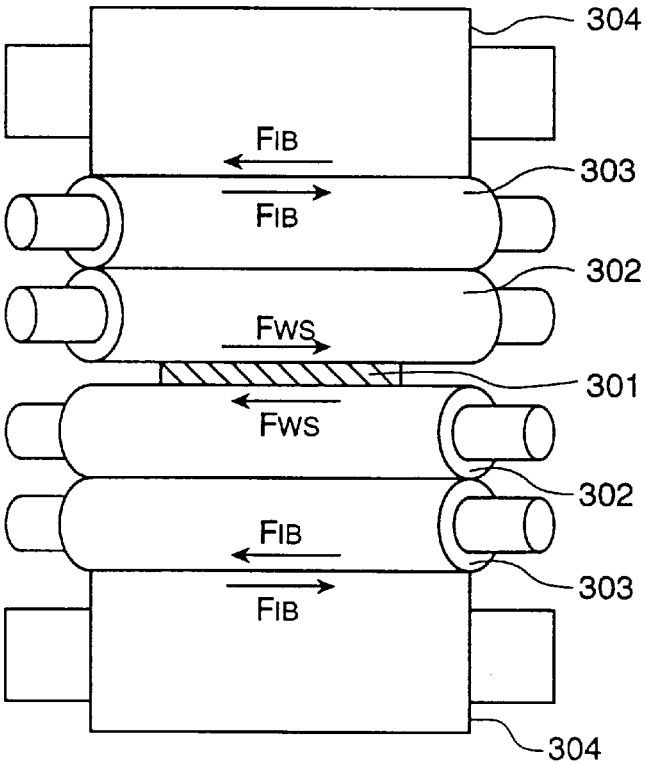
Figure 5:
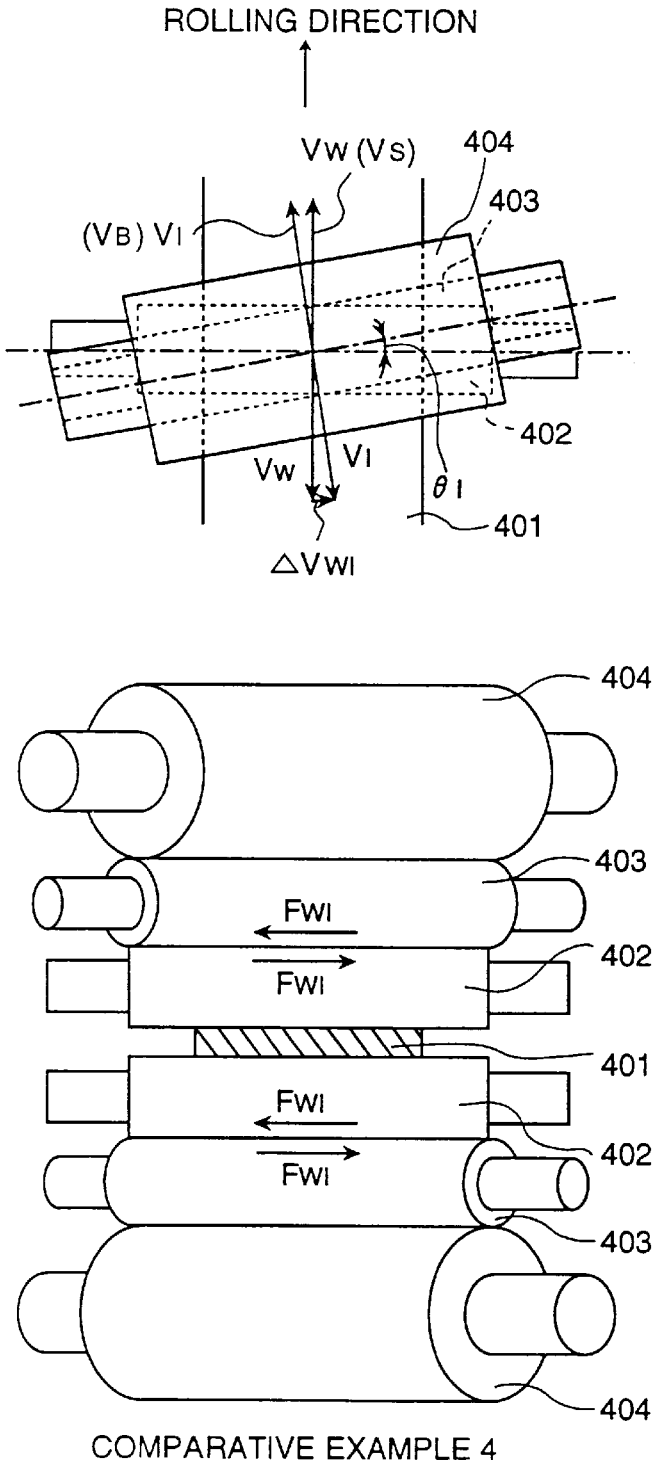
FIG. 5 is a view of a roll arrangement of a 6-high mill for explaining a thrust occurrence mechanism in a case where the intermediate rolls and backup rolls are arranged to cross as one unit.
Figure 6:
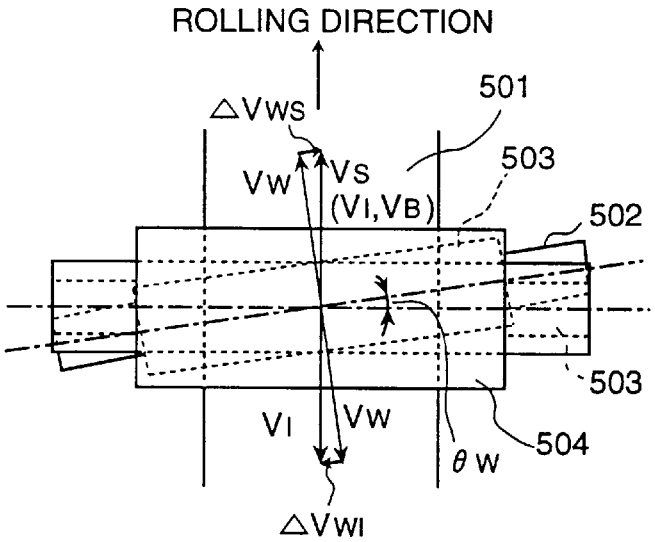
FIG. 6 is a view of a roll arrangement of a 6-high mill for explaining a thrust occurrence mechanism in a case where only the work rolls are arranged to cross.
Figure 6:
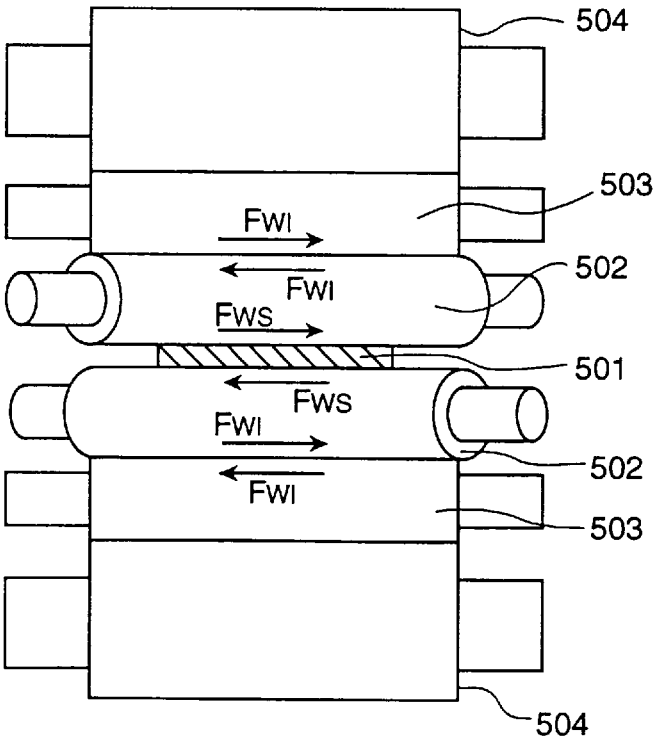
Figure 7:
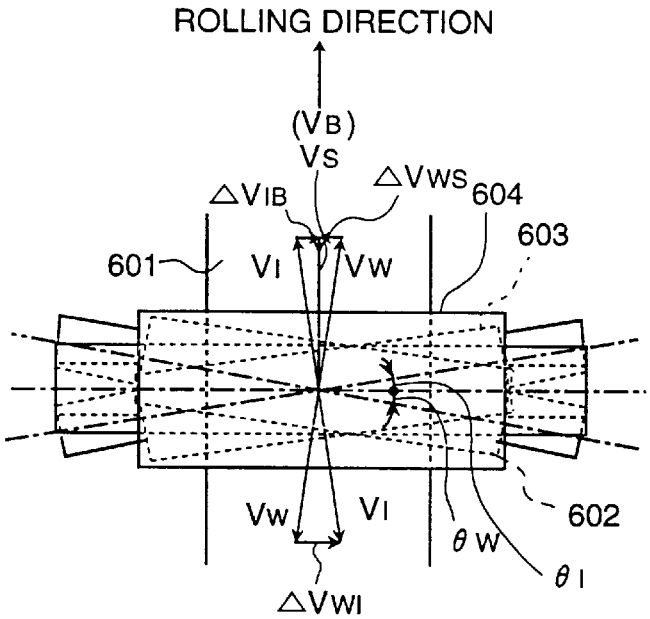
FIG. 7 is a view of a roll arrangement of a 6-high mill for explaining a thrust occurrence mechanism in a case where the intermediate rolls and work rolls are arranged to cross the axis of the backup rolls so that the axes of the intermediate rolls and the axes of the work rolls incline in opposite direction to each other.
Figure 7:
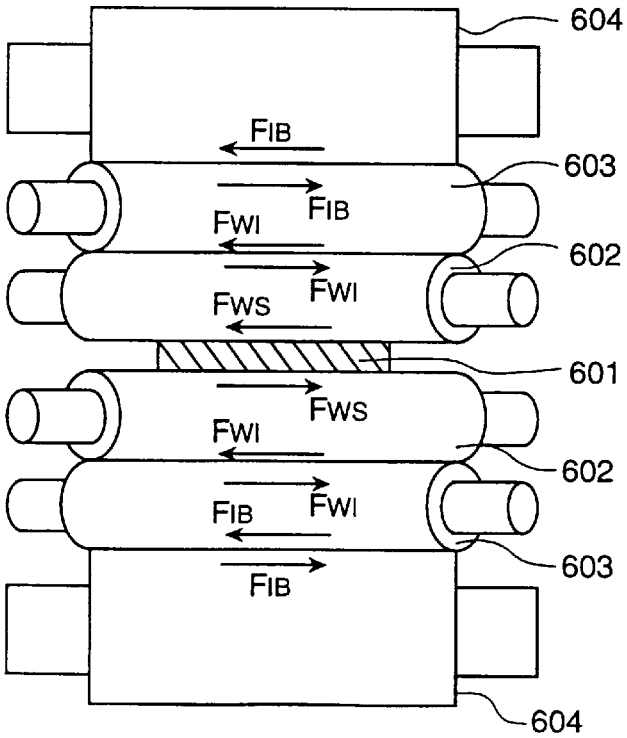
Figure 12A:
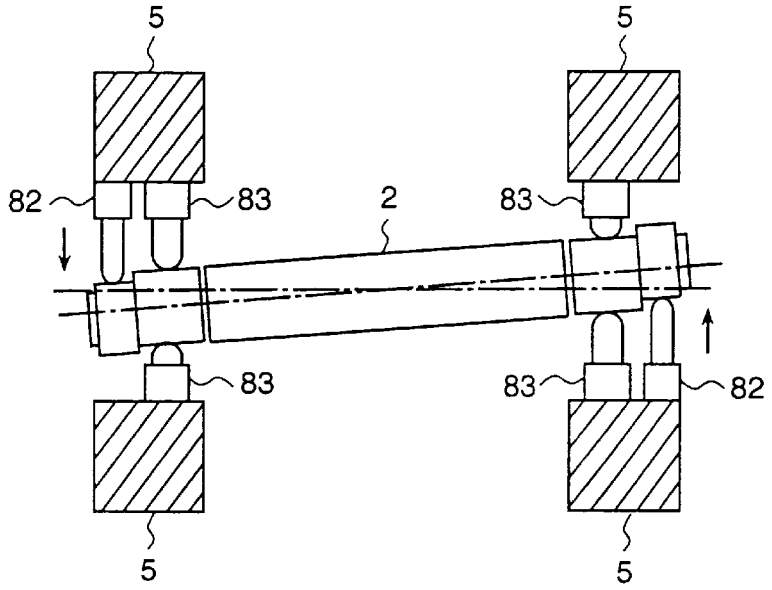
FIG. 12A is a view showing a mechanism of work roll bender imparting bending force in a horizontal direction.
Figure 12B:
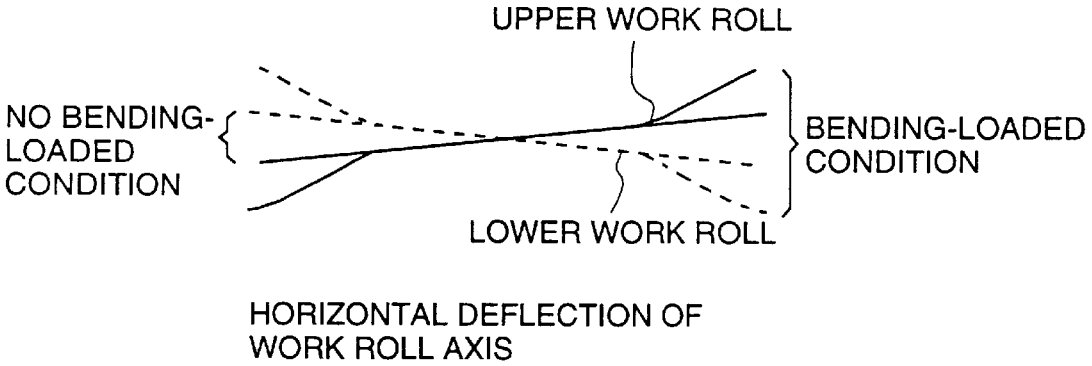
FIG. 12B is a view showing a change of the axis (deflection) of the work roll by the work roll bender.

FIGS. 12A and 12B show an embodiment in which the mill is provided with such work roll benders 82 as mentioned above. As shown in FIG. 12A, a cross position of the work roll 2 is determined by work roll cross cylinders 83, and under this condition, bending force is added in a horizontal direction by the work roll benders 82, whereby a change (deflection) of the axis of the work roll 2 occurs, particularly, around roll end portions thereof. The deflection is shown in FIG. 2(*b*). When the work roll 2 is deflected, roll gaps around the ends thereof also change, so that it is possible to correct the thickness distributions in ends of a plate, using this phenomenon.

Figure 13:
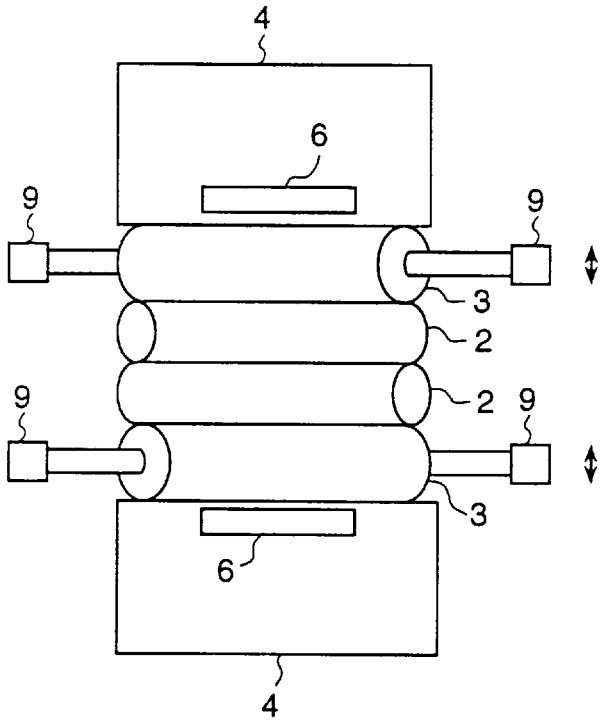
FIG. 13 is a view of a roll arrangement of a 6-high mill of a third embodiment of the present invention.

Next, a third embodiment of the present invention is described, referring to FIG. 13. In FIG. 13, a plate is omitted and the same reference numbers are given to parts equivalent to those in FIG. 8.

As shown in FIG. 13, backup rolls 4 are arranged so that their axes cross perpendicularly a direction of a travelling of a plate and do not incline against a perpendicular direction of the plate travelling direction in a horizontal plane. Intermediate rolls 3 and work rolls are arranged so that their axes incline against (cross) the axis of the backup roll 4 in opposite directions to each other. The intermediate rolls 3 each have intermediate roll benders 9 mounted on both ends for imparting roll bending force thereon. Since the intermediate rolls 3 each also have a small diameter, benders for imparting bending force in a horizontal direction can be used as the intermediate roll benders 9 in the same manner as the work roll bender of FIG. 12A. Lubricant supplying apparatus 6 is provided for supplying lubricant on the roll surfaces.

In this embodiment also, since the intermediate rolls 3 and the work rolls 2 cross in the opposite directions and lubrication is employed, the same effect as the first embodiment can be attained.

Further, according to this embodiment, by joint use of the intermediate roll benders 9, in a case where an error occurs in setting the cross angle of the intermediate rolls 3, the erroneous setting can be corrected. That is, a part of gap influenced on a vertical gap by the error in setting of the cross angle can be corrected by bending vertically the intermediate roll 3, using the intermediate roll benders 9, whereby the cross angle setting error of the intermediate roll 3 can be easily corrected. Therefore, correction of thickness distribution in the plate width direction is possible in a short time even during rolling, a more uniform thickness distribution can be secured, and plates of excellent quality can be produced.

Figure 14:
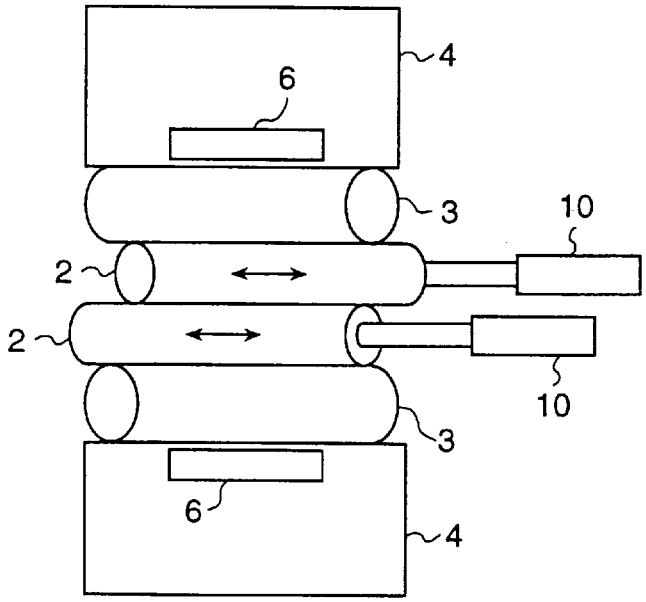
FIG. 14 is a view of a roll arrangement of a 6-high mill of a fourth embodiment of the present invention.

Next, a fourth embodiment of the present invention is described, referring to FIG. 14. In FIG. 14, a plate is omitted and the same reference numbers are given to parts equivalent to those in FIG. 8.

As shown in FIG. 14, backup rolls 4 are arranged so that their axes cross perpendicularly a direction of a travelling of a plate and do not incline against a perpendicular direction of the plate travelling direction in a horizontal plane. Intermediate rolls 3 and work rolls are arranged so that their axes incline against (cross) the axis of the backup roll 4 in opposite directions to each other, and work roll shift apparatus 10 are provided for enabling the work rolls 2 to axially shift. Further, lubricant supplying apparatus 6 are provided for supplying lubricant on the roll surfaces.

In this embodiment also, since the intermediate rolls 3 and the work rolls 2 cross in the opposite directions and roll lubrication is employed, the same effect as the first embodiment can be attained.

Further, in a case where rolling is carried out by arranging the intermediate rolls and the work rolls each to cross, a load by the rolling load, particularly, at the central portion of the barrel length direction of the work roll becomes large, so that metal fatigue etc. is apt to easily concentrate at the central portion. According to this embodiment, since the work roll 2 is made axially shiftable by the work roll shift apparatus 10, the load can be scattered even during rolling for long time and the concentration of the metal fatigue can be avoided, whereby the life of the work roll can be extended.

Figure 15:
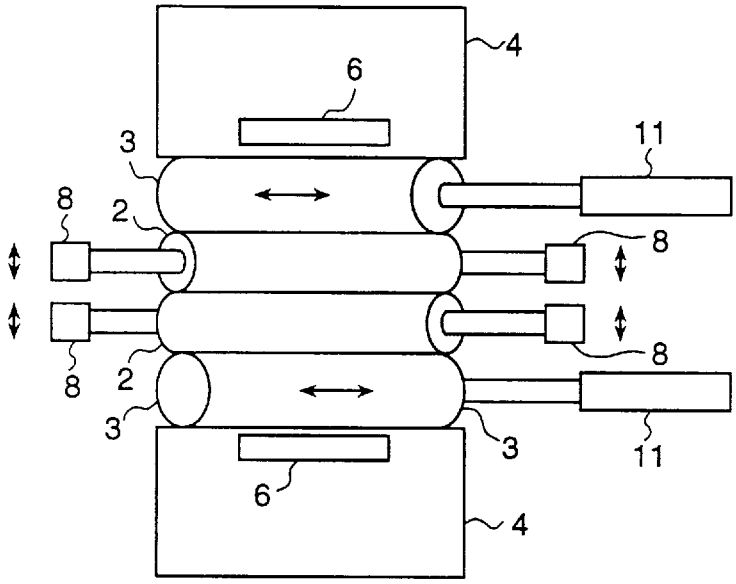
FIG. 15 is a view of a roll arrangement of a 6-high mill of a fifth embodiment of the present invention.

Next, a fifth embodiment of the present invention is described, referring to FIG. 15. In FIG. 15, a plate is omitted and the same reference numbers are given to parts equivalent to those in FIGS. 8 and 11.

As shown in FIG. 15, backup rolls 4 are arranged so that their axes cross perpendicularly a direction of a travelling of a plate and do not incline against a perpendicular direction of the plate travelling direction in a horizontal plane. Intermediate rolls 3 and work rolls are arranged so that their axes incline against (cross) the axis of the backup roll 4 in opposite directions to each other. Further, intermediate roll shift apparatus 11 are provided for enabling the intermediate rolls 3 to axially shift. The work rolls 2 have work roll benders 8 mounted on both end portions thereof for imparting bending force on the rolls. Further, lubricant supplying apparatus 6 are provided for supplying lubricant on the roll surfaces.

In this embodiment also, since the intermediate rolls 3 and the work rolls 2 cross in the opposite directions and roll lubrication is employed, the same effect as the first embodiment can be attained.

Further, according to the present embodiment, the intermediate rolls 3 are made axially shiftable by the intermediate roll shift apparatus 11, and the work rolls 2 are provided with the work roll benders 8, so that a region in which bending by the work roll benders 8 is effective can be changed. That is, it is possible to control body crown at a central portion of a plate by changing a cross angle of the intermediate roll 3, and restrictively influence an effect by the work roll benders 8 on only plate end portions or influence it to the central portion of the plate. Therefore, it is possible to easily carry out correction of complicated plate width-wise thickness distribution by the edge drop control, composite elongation control, etc., whereby a uniform thickness distribution can be secured and plates of excellent quality can be produced.

The first to fifth embodiments have been explained above. The invention represented by the embodiments is applicable to both hot rolling and cold rolling. In the hot rolling, slab materials and bar materials of relatively short length are rolled in many cases. In such a case, biting of tip ends of rolling materials is repeatedly effected many times, so that it is necessary to pay attention not to slip at time of biting. That is, in a case where a lubricant of a high lubricity is used, slip easily occurs even between the plate and the roll, so that it becomes a cause of insufficient biting. Therefore, as a lubricant used for hot rolling, required is such a property, which may appear to be contradictory, that a high lubricity is exhibited between the rolls but the lubricity is low between the plate and the roll. However, taking into consideration that a temperature between the rolls is 100° C. or less and a rolling material has a high temperature of about 1,000° C., the requirement is satisfied by using a lubricant having the property that the lubricity is high at a low temperature and low at a high temperature.

Figure 16:
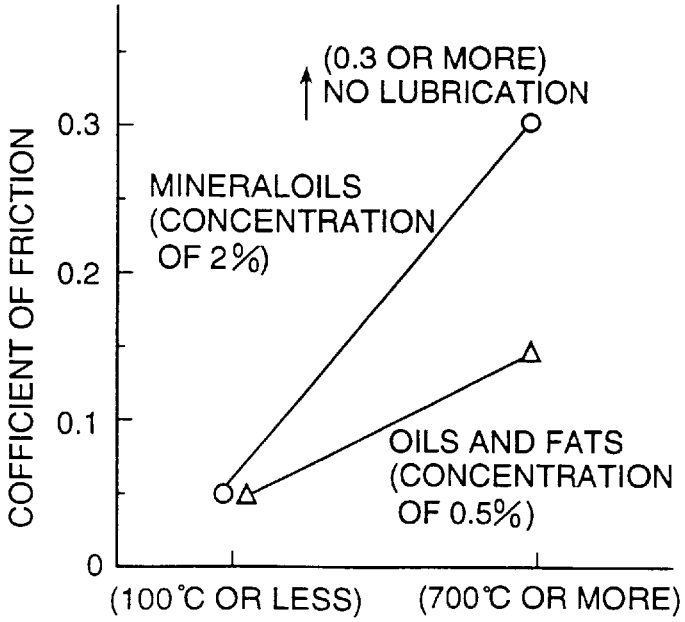
FIG. 16 is a graph showing change in coefficient of friction of a lubricant of oils and fats and a lubricant of mineral oil according to change (high and low) in temperature.

FIG. 16 shows test results of lubricant conducted by the inventors. A change in coefficient of friction according to a change in temperature is small in a case a lubricant (concentration of 0.5%) of oils and fats is used, but the frictional coefficient changes largely as the temperature changes in a case where a lubricant (concentration of 2%) of mineral oils is used. That is, the lubricant of mineral oils satisfies the above requirement that the lubricity is high between the rolls and low between the rolling material and the roll, and it is noted the lubricant is suitable for lubrication between the rolls in hot rolling. In this manner, in the hot rolling, by using, as lubricant, a lubrication oil which has mineral oil as base oil, it is possible to secure lubrication between the rolls, prevent insufficient biting by slip at time of biting and effect stable rolling.

Figure 17:
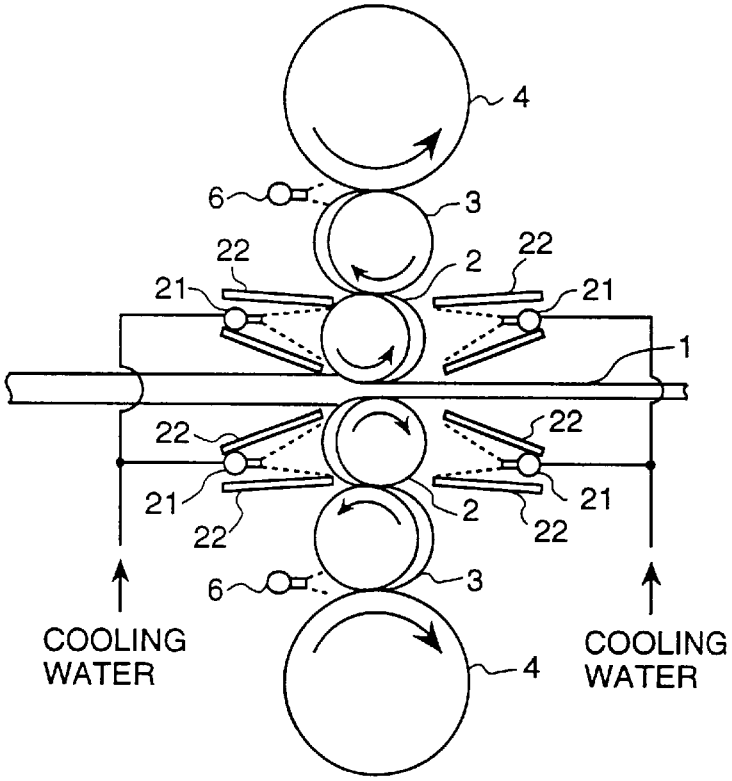
FIG. 17 is a view of a roll arrangement of a 6-high mill of a sixth embodiment of the present invention.

Next, a sixth embodiment of the present invention is described, referring to FIG. 17. In FIG. 17, the same reference numbers are given to parts equivalent to those in FIG. 8.

As shown in FIG. 17, backup rolls 4 are arranged so that their axes cross perpendicularly a direction of a travelling of a plate and do not incline against a perpendicular direction of the plate travelling direction in a horizontal plane. Intermediate rolls 3 and work rolls are arranged so that their axes incline against (cross) the axis of the backup roll 4 in opposite directions to each other. Cooling water supplying apparatus 21 are provided for injecting cooling water in the work rolls 2, and scrapers (cooling water shielding members) 22 are arranged in the vicinity of the work rolls 2 for preventing cooling water from the cooling water supplying apparatus 21 from scattering and adhering onto the intermediate rolls. Further, lubricant supplying apparatus 6 are provided for supplying lubricant on the roll surfaces.

In this embodiment also, since the intermediate rolls 3 and the work rolls 2 cross in the opposite directions and roll lubrication is employed, the same effect as the first embodiment can be attained.

Further, according to the present embodiment, by providing the scrapers 22 in the vicinity of the work rolls 2, it is possible to prevent a lot of cooling water for the work rolls jetted from the cooling water supplying apparatus 21 from scattering and adhering to the intermediate roll 3 or penetrating into between the rolls. Thereby, it becomes unnecessary to decrease an amount of water, whereby the work rolls can be sufficiently cooled and rolling defect such as seizure can be prevented. Further, since excessive growth of thermal crown also can be prevented, a more uniform thickness distribution can be secured and plates of excellent quality can be produced.

Figure 18:
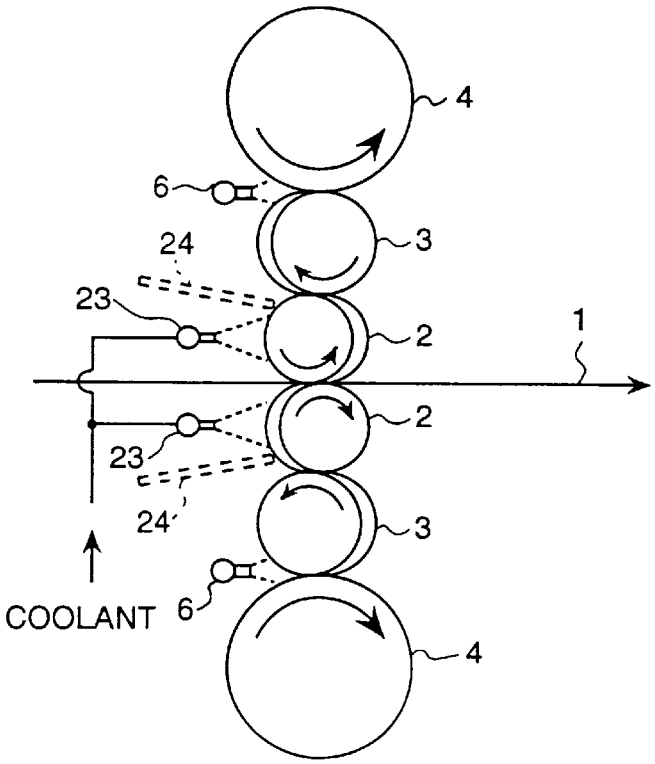
FIG. 18 is a view of a roll arrangement of a 6-high mill of a seventh embodiment of the present invention.

Next, a seventh embodiment of the present invention is described, referring to FIG. 18. In FIG. 18, the same reference numbers are given to parts equivalent to those in FIG. 8.

In the sixth embodiment (FIG. 17), the case in which the present invention is applied to hot rolling is explained. In cold rolling, in many cases, plates are continuously supplied and continuously rolled by introduction of splicers. In such cold rolling, the work rolls are always in a condition of rolling, so that the thermal crown is easily grown to be large. In order to prevent this phenomenon, a coolant of high cooling ability is needed. For obtaining such coolant, a method of making large the content of water in a coolant is low in cost and simple. However, in a case where such coolant is tried to use for inter-roll lubrication, the content of water is large and adhering force to the roll surfaces is easily lowered, so that it is not so suitable as lubricant. In this embodiment, in consideration of this, what differs in oily property and concentration from the coolant for the work rolls is used as lubricant for inter-roll lubrication.

As shown in FIG. 18, the backup rolls 4 are arranged so that their axes cross perpendicularly the travelling direction of a plate and do not incline against the direction in a horizontal plane. The intermediate rolls 3 and work rolls 2 are arranged so that respective axes incline to (cross), in counter directions to each other, the axis of each backup roll 4 in a horizontal plane. Further, coolant supplying apparatus 23 for injecting coolant onto the work rolls 2 are provided, and lubricant is supplied onto the surfaces of the work rolls 2 by lubricant supplying apparatus 6. As a coolant to be supplied from the lubricant supplying apparatus 6, a lubricant which is different in oily property or concentration from the coolant supplied from the coolant supplying apparatus 23 is used. Further, in this embodiment, it is possible to provide scrapers (coolant shielding members) 24 at positions in the vicinity of the work rolls 2, whereby it is possible to prevent the coolant from scattering and adhering to the intermediate rolls 3 or entering between the rolls.

In this embodiment also, since the intermediate rolls 3 and work rolls 2 are arranged to cross in counter directions to each other and roll lubrication is employed, the same effect as in the first embodiment can be attained.

Further, according to the present embodiment, since as a lubricant supplied from the lubricant supplying apparatus 6, a lubricant which differs in oily property or concentration from the coolant supplied from the coolant supplying apparatus 23 is used, effective inter-roll lubrication can be effected while keeping a high cooling ability as coolant also.

Further, by providing the scrapers 24 in the vicinity of the work rolls 2, it is possible to prevent the coolant jetted from the coolant supplying apparatus 23 from scattering and adhering to the intermediate roll 3 or entering between the rolls. Thereby, it becomes unnecessary to decrease an amount of coolant, whereby the work rolls 2 can be sufficiently cooled and rolling defect such as seizure can be prevented. Further, since excessive growth of thermal crown also can be prevented, a more uniform thickness distribution can be secured and plates of excellent quality can be produced.

Figure 19:
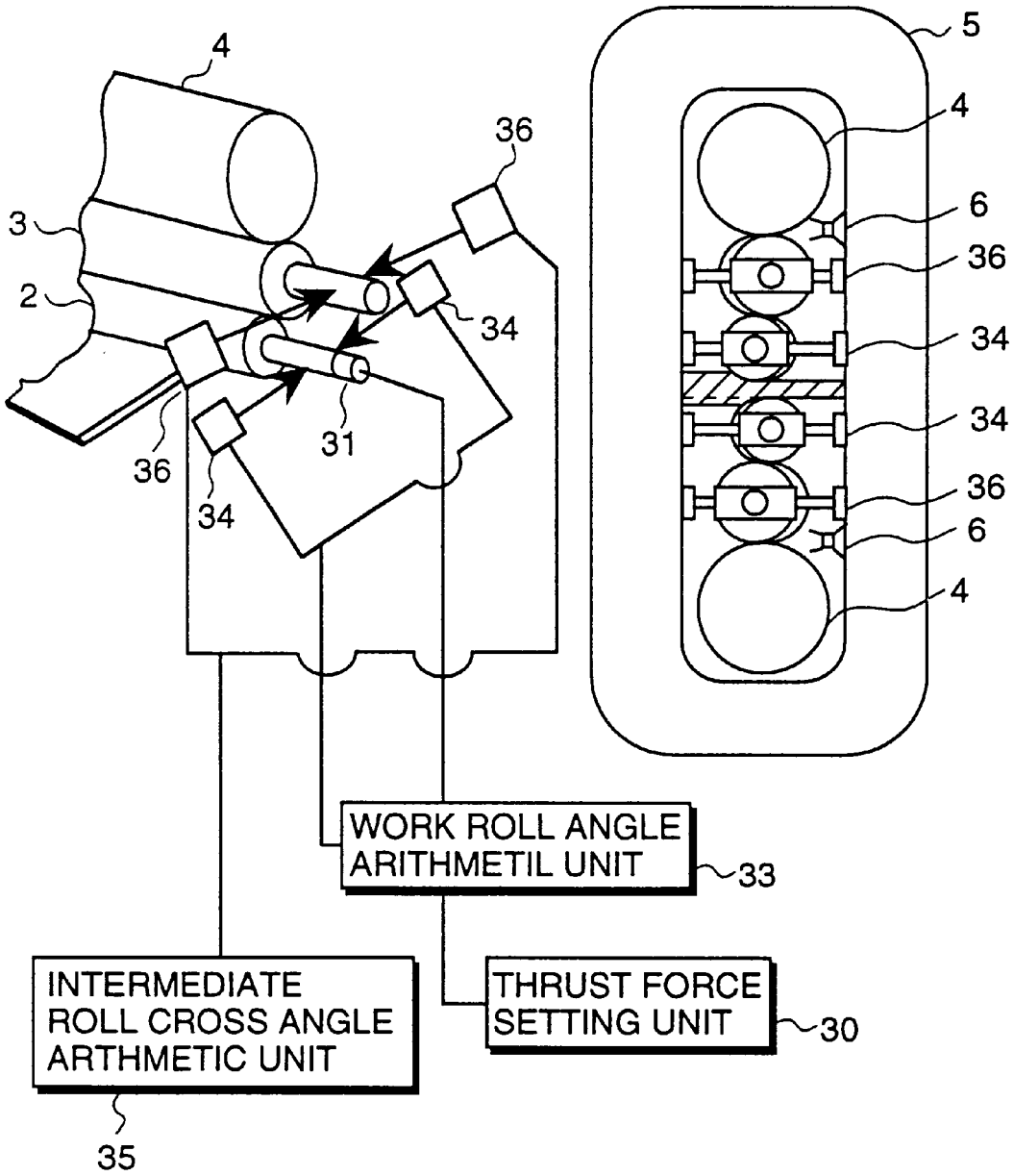
FIG. 19 is a view of a roll arrangement of a 6-high mill of a eighth embodiment of the present invention.

An eighth embodiment of the present invention is described, referring to FIG. 19. In FIG. 19, the same reference numbers are given to parts equivalent to those in FIG. 8.

In FIG. 19, the backup rolls 4 are arranged so that their axes cross perpendicularly the travelling direction of a plate and do not incline against the direction in a horizontal plane.

The intermediate rolls 3 and work rolls 2 are arranged so that respective axes incline to (cross), in counter directions to each other, the axis of each backup roll 4 in a horizontal plane. Further, a lubricant is supplied onto the surfaces of the work rolls 2 by lubricant supplying apparatus 6.

A 6-high mill of the present embodiment is provided with a work roll thrust force measuring unit 31 for measuring the thrust force of the work roll 2 in the axial direction, a thrust force setting unit 32 for setting an allowable thrust force, a work roll cross angle arithmetic unit 33 for comparing a set value from the thrust force setting unit 32 and a measured thrust force value and calculating a cross angle change amount of the work roll 2, an intermediate roll cross angle arithmetic unit 35 for calculating a cross angle change amount of the intermediate roll 3 according to the cross angle change amount of the work roll 2, a work roll cross angle changing unit 34 for receiving a signal from the work roll cross angle arithmetic unit 33 and changing the cross angle of the work roll 2, and an intermediate roll cross angle changing unit 36 for receiving a signal from the intermediate roll cross angle arithmetic unit 35 and changing the cross angle of the intermediate roll 3.

Further, the cross angle of the work roll 2 is set to 0.2 degrees or more, and the cross angle of the intermediate roll 3 is set to 0.1 degrees or more (0.3 degrees or more in view of cross angle between it and the work roll 2). The work roll cross angle arithmetic unit 33 calculates a cross angle change amount of the work roll 2 in a cross angle range of 0.2 degrees or more, and the intermediate roll cross angle arithmetic unit 35 calculates a cross angle change amount of the intermediate roll 3 in a cross angle range of 0.1 degrees or more.

The axial thrust force of the work roll 2 is measured by the work roll thrust force measuring unit 31, and the measured thrust force value and the value set in advance by the thrust force setting unit 32 are compared by the work roll cross angle arithmetic unit 33. Arithmetic operation of the comparing is performed as follows.

The measured thrust force value Fsm is extracted from the set value Fsf from the thrust force setting unit 32, whereby thrust force ΔFs to be corrected is obtained. If the measured thrust force Fsm is smaller than the set value Fsf, subsequent processing is unnecessary and not conducted.

The thrust force Fs occurring on the work roll 2 is expressed as follows from the thrust force Fr occurring between the rolls and the thrust force Fp occurring on the plate and the roll:

$$Fs=Fr-Fp \tag{1}$$

Fr and Fp can be expressed as follows, using the rolling load Pr and the thrust coefficient $\mu e$ between rolls and the thrust coefficient $\mu p$ between the plate and the work roll, as shown in FIG. 2:

$$Fr=\mu e\times Pr \tag{2}$$

$$Fp=\mu p\times Pr \tag{3}$$

In order to reduce the thrust coefficient $\mu e$, a lubricant such as emulsion is supplied onto the roll surfaces by the lubricant supplying apparatus 6, however, the thrust coefficient in a cross angle range of 0.1–1.2 degrees is 6–8%, the change amount of which is only 2%. Therefore, as mentioned previously, even if the cross angle of the intermediate roll 3 is changed, an influence affecting the thrust force is small. On the other hand, the thrust coefficient Up between the plate and the work roll 2 is 0–10% in a cross angle range of 0.0–1.2 degrees, the change width of the coefficient is 10% which is large. Further, since a cross angle θ between the plate and the work roll 2 is nearly in proportion to the thrust coefficient $\mu p$ between the plate and the work roll, the thrust coefficient $\mu p$ is expressed as follows:

$$\mu p=Cp\times\theta+D \tag{4}$$

where Cp is proportional constant, D is initial constant. Since a change of the thrust coefficient $\mu e$ between the rolls due to a cross angle change amount Δθ of the work roll is small, by disregarding it, a relation between the cross angle change amount Δθ of the work roll and a change amount ΔFs of the thrust force is expressed approximately as follows:

$$\Delta Fs=-Pr\times Cp\times\Delta\theta \tag{5}$$

From the equation (5), a work roll cross angle change amount Δθ to be corrected for the thrust force ΔFs to be corrected can be calculated as follows:

$$\Delta\theta=-Fs/(Pr\times Cp) \tag{6}$$

The work roll cross angle changing unit 34 receives a signal from the work roll cross angle arithmetic unit 33 and changes the cross angle of the work roll. Thereby, the excessively large thrust force is corrected. In the above explanation, although a change of the thrust coefficient $\mu p$ is disregarded, even in consideration of this small change, calculation similar to the above is possible and it is not different in essence from the present invention.

The intermediate roll cross angle arithmetic unit 35 receives a signal from the work roll cross angle arithmetic unit 33 and calculates a change amount ΔθI of the intermediate roll 3. A relation among a plate crown change amount ΔCh of the plate, a cross angle change amount Δθ of the work roll and a cross angle change amount ΔθI of the intermediate roll is expressed generally as follows:

$$\Delta Ch=(\partial Ch/\partial\theta)\times\Delta\theta+(\partial Ch/\partial\theta I)\times\Delta\theta I \tag{7}$$

where Ch is plate crown, θ is a work roll cross angle, θI is an intermediate roll cross angle. A coefficient (∂Ch/∂θ) and a coefficient (∂Ch/∂θI) can be obtained in advance by calculation or an experiment.

The following equation is obtained by making ΔCh=0 in the equation (7):

$$\Delta\theta I=-(\partial Ch/\partial\theta)\times\Delta\theta/(\partial Ch/\partial\theta I) \tag{8}$$

The equation (8) expresses an equivalent cross angle change amount ΔθI of the intermediate roll 3 for cancelling a plate crown change amount due to a work roll cross angle change amount Δθ.

The intermediate roll cross angle changing unit 36 receives a signal from the intermediate roll cross angle arithmetic unit 35 and changes the cross angle of the intermediate roll 3. Thereby, a plate crown change due to the cross angle change amount Δθ of the work roll 2 is made zero, whereby the plate quality can be kept excellent.

As mentioned above, in the present embodiment, since the cross angle of the work roll 2 is changed in a range in which the cross angle of the work roll 2 becomes 0.2 degrees or more and the cross angle of the intermediate roll 3 is changed in a range in which the cross angle of the intermediate roll becomes 0.1 degrees or more, the intermediate roll is used when the cross angle of the intermediate roll to the backup roll 4 is 0.1 degrees or more and when the cross angle to the work roll 2 is 0.3 degrees or more. Further, as mentioned above, the thrust coefficient between the rolls becomes small in its change and stabilized at a cross angle of 0.1 degrees or more. Therefore, the intermediate roll cross angle changing unit 36 receives a signal from the intermediate roll cross angle arithmetic unit 35 and changes the cross angle of the intermediate roll 3, whereby occurrence of the thrust force can be more stably prevented, an influence on a difference between left and right loads, accompanied by correction of the thickness distribution can be suppressed to be small and further excellent quality of plates can be kept.

According to the present embodiment, since the intermediate rolls 3 and work rolls 2 are arranged to cross in opposite directions to each other, and the inter-roll lubrication is employed, an effect similar to that in the first embodiment can be attained, even if the thrust force of the work rolls increases during rolling from one cause or another, the thrust force can be surely reduced, an influence on a difference between left and right loads, accompanied by correction of the thickness distribution can be suppressed to be small, and further excellent quality of plates can be kept.

According to the present invention, it is possible to roll stably to produces excellent plates, that is, a uniform thickness distribution can be secured and plates of excellent quality can be produced, without such disadvantages that the roll crossing is limited by occurrence of excessively large thrust force to cause an ununiform thickness distribution and plate quality is worsened.

Further, even if the thrust force of the work rolls increases during rolling from one cause or another, the thrust force can be surely reduced, an influence on a difference between left and right loads, accompanied by correction of the thickness distribution can be suppressed to be small, and further excellent quality of plates can be kept.

The work rolls are provided with the work roll benders, so that correction of thickness distribution in the plate width direction can be easily performed in a short time, uniform thickness distribution can be secured and plates of excellent quality can be produced.

Since the intermediate rolls are provided with intermediate roll benders, errors in setting a cross angle of the intermediate rolls can be easily corrected, therefore, correction of thickness distribution in the plate width direction can be easily performed in a short time, uniform thickness distribution can be secured and plates of excellent quality can be produced.

Since the work rolls each are made shiftable in the axial direction, concentration of load on a central portion of the barrel portion of the work roll can be avoided, whereby metal fatigue can be dispersed, whereby the life of the work rolls can be extended.

Further, since the intermediate rolls are made axially shiftable and the work rolls are provided with the work roll benders, complicated correction of thickness distribution in the plate width direction such as control for edge drop, control for composite elongation can be easily performed, uniform thickness distribution can be secured, and plates of high quality can be produced.

Further, according to the present invention, the cooling water supplying apparatus is provided at positions close to the work rolls, so that it is possible to prevent a lot of cooling water for the work rolls from scattering and adhering to the intermediate rolls or entering between the rolls. Therefore, it becomes unnecessary to reduce an amount of the cooling water, so that the working rolls 2 can be sufficiently cooled and rolling defect such as seizure can be prevented. Further, since excessively large growth of thermal crown also can be prevented, so that uniform thickness distribution can be secured and plates of high quality can be produced.

Further, as a lubricant for inter-roll lubrication, a lubricant which differs in oily property or concentration from the coolant for the working rolls is used, so that sufficient inter-roll lubrication can be performed while keeping a high cooling ability. Further, in this case, by providing coolant shielding members at positions close to the work rolls, it is possible to prevent the coolant from scattering and adhering to the intermediate rolls or entering between the rolls. Therefore, since excessively large growth of thermal crown also can be prevented, uniform thickness distribution can be secured and plates of high quality can be produced.

What is claimed is:

1. A rolling mill provided with a pair of work rolls for rolling a plate, a pair of intermediate rolls supporting said pair of work rolls, respectively and a pair of backup rolls supporting said pair of intermediate rolls, respectively, in mill stands, wherein said pair of backup rolls are arranged so that the axial lines of said pair of backup rolls do not incline to each other in a horizontal plane, said intermediate rolls and work rolls are arranged so that each of the axial lines of said intermediate rolls and work rolls can incline contrarily to the axial lines of said backup rolls in a horizontal plane, and said rolling mill comprises:

a lubricant supplying apparatus for supplying lubricant to the roll surfaces of said work rolls, intermediate rolls and backup rolls, a work roll thrust force measuring unit for measuring thrust force of said work rolls in an axial direction, a thrust force setting unit for setting an allowable thrust force, a work roll cross angle arithmetic unit for comparing a set value from said thrust force setting unit and a measured value of thrust force and calculating a change amount of cross angle of said work rolls, an intermediate roll cross angle arithmetic unit for calculating a change amount of cross angle of said intermediate rolls according to the change amount of cross angle of said work rolls, a work roll cross angle changing unit for receiving a signal from said work roll cross angle arithmetic unit and changing the cross angle of said work rolls, and an intermediate roll cross angle changing unit for receiving a signal from said intermediate roll cross angle arithmetic unit and changing the cross angle of said intermediate rolls.

2. A rolling mill according to claim 1, wherein said work roll cross angle arithmetic unit calculates such a change amount of the cross angle of said work rolls that when the measured value of thrust force is larger than the set value form said thrust force setting unit, a difference from the set value becomes small, and said intermediate roll cross angle arithmetic unit calculates such a change amount of the cross angle of said intermediate rolls that a change amount in thickness distribution of said plate due to the change amount of the cross angle of said work rolls is cancelled.

3. A rolling mill according to claim 1, wherein in a case where an angle of each work roll to a direction perpendicular to a rolling direction of said plate is defined as a cross angle of work roll and an angle of each intermediate roll to a direction perpendicular to a rolling direction of said plate is defined as a cross angle of intermediate roll, said work roll cross angle arithmetic unit obtains a change amount of the cross angle of said work rolls in a range in which the cross angle of said work roll is 0.2 degrees or more, said intermediate roll cross angle arithmetic unit obtains a change amount of the cross angle of said intermediate rolls in a range in which the cross angle of said intermediate roll is 0.1 degrees or more counter to said work roll.

4. A rolling method of rolling a plate, using a rolling mill provided with a pair of work rolls, a pair of intermediate rolls supporting said pair of work rolls, respectively and a pair of backup rolls supporting said pair of intermediate rolls, respectively, in mill stands, characterized by arranging said pair of backup rolls so that the axial lines of said pair of backup rolls do not incline to each other in a horizontal plane, arranging said intermediate rolls and work rolls so that each of the axial lines of said intermediate rolls and work rolls can incline contrarily to the axial lines of said backup rolls in a horizontal plane, and rolling a plate while supplying a lubricant to the roll surfaces of said work rolls, intermediate rolls and backup rolls.

5. A rolling method according to claim 4, further comprising setting a cross angle of said work rolls so that thrust force occurring at said work rolls does not become excessively large, and setting a cross angle of said intermediate rolls so that said plate has a desired thickness distribution, taking into consideration the cross angle of said work rolls.

6. A rolling method according to claim 4, further comprising setting a cross angle of said work roll 0.2 degrees or more, and a cross angle of said intermediate roll 0.1 degrees or more counter to said work roll when an angle of each work roll to a direction perpendicular to a rolling direction of said plate is defined as a cross angle of work roll and an angle of each intermediate roll to a direction perpendicular to a rolling direction of said plate is defined as a cross angle of intermediate roll, when the plate is rolled.

7. A rolling method according to claim 4, further comprising imparting bending force on at least one side of said work rolls and said intermediate rolls when the plate is rolled.

8. A rolling method according to claim 4, further comprising shifting at least one of said work or intermediate rolls in an axial direction when the plate is rolled.

9. A rolling method according to claim 4, further comprising supplying a coolant to said work rolls and using, as said lubricant, a lubricant which differs in oily property or concentration from the coolant for said work rolls while cold rolling the plate.

10. A rolling method according to claim 4, further comprising supplying coolant to said work rolls and preventing said coolant from adhering to said intermediate rolls by using a coolant shielding member arranged at a position adjacent to said work rolls while cold rolling the plate.

11. A rolling method according to claim 5, further comprising supplying a coolant to said work rolls and using, as said lubricant, a lubricant which differs in oily property or concentration from the coolant for said work rolls while the plate is cold rolled.

12. A rolling method according to claim 5, further comprising supplying coolant to said work rolls and preventing said coolant from adhering to said intermediate rolls by using a coolant shielding member arranged at a position adjacent to said work rolls while the plate is cold rolled.

13. A rolling method according to claim 6, further comprising supplying a coolant to said work rolls and using, as said lubricant, a lubricant which differs in oily property or concentration from the coolant for said work rolls while the plate is cold rolled.

14. A rolling method according to claim 6, further comprising supplying coolant to said work rolls and preventing said coolant from adhering to said intermediate rolls by using a coolant shielding member arranged at a position adjacent to said work rolls while the plate is cold rolled.

15. A rolling method according to claim 7, further comprising horizontally imparting a bending force to said work rolls.

16. A rolling method according to claim 7, further comprising supplying a coolant to said work rolls and using, as said lubricant, a lubricant which differs in oily property or concentration from the coolant for said work rolls while the plate is cold rolled.

17. A rolling method according to claim 7, further comprising supplying coolant to said work rolls and preventing said coolant from adhering to said intermediate rolls by using a coolant shielding member arranged at a position adjacent to said work rolls while the plate is cold rolled.

18. A rolling method according to claim 15, further comprising supplying a coolant to said work rolls and using, as said lubricant, a lubricant which differs in oily property or concentration from the coolant for said work rolls while the plate is cold rolled.

19. A rolling method according to claim 15, further comprising supplying coolant to said work rolls and preventing said coolant from adhering to said intermediate rolls by using a coolant shielding member arranged at a position adjacent to said work rolls while the plate is cold rolled.

20. A rolling method according to claim 8, further comprising supplying a coolant to said work rolls and using, as said lubricant, a lubricant which differs in oily property or concentration from the coolant for said work rolls while the plate is cold rolled.

21. A rolling method according to claim 8, further comprising supplying coolant to said work rolls and preventing said coolant from adhering to said intermediate rolls by using a coolant shielding member arranged at a position adjacent to said work rolls while the plate is cold rolled.

22. A rolling method of rolling a plate, using a rolling mill provided with a pair of work rolls, a pair of intermediate rolls supporting said pair of work rolls, respectively and a pair of backup rolls supporting said pair of intermediate rolls, respectively, in mill stands, wherein said method comprises the steps of:

arranging said pair of backup rolls so that the axial lines of said pair of backup rolls do not incline to each other in a horizontal plane, arranging said intermediate rolls and work rolls so that each of the axial lines of said intermediate rolls and work rolls can incline contrarily to the axial lines of said backup rolls in a horizontal plane, rolling a plate while supplying a lubricant to the roll surfaces of said work rolls, intermediate rolls and backup rolls, and measuring thrust force of said work rolls in an axial direction, comparing a measured value of thrust force with a value set in advance to calculate a difference therebetween, changing the cross angle of said work rolls according to the difference, and changing the cross angle of said intermediate rolls according to a changed value of cross angle of said work rolls.

23. A rolling method according to claim 22, further comprising changing the cross angle of said work rolls when the measured value of thrust force is larger than the set value from said thrust force setting unit, so that the difference becomes small, and changing the cross angle of said intermediate rolls so as to cancel a change amount in thickness distribution of said plate due to the change amount of the cross angle of said work rolls is canceled.

24. A rolling method according to claim 22, further comprising changing the cross angle of said work rolls in a range in which the cross angle of said work roll is 0.2 degrees or more, and changing the cross angle of said intermediate rolls in a range in which the cross angle of said intermediate roll is 0.1 degrees or more counter to said work roll when the angle of each work roll to a direction perpendicular to a rolling direction of said plate is defined as a cross angle of work roll and an angle of each intermediate roll to a direction perpendicular to a rolling direction of said plate is defined as a cross angle of intermediate roll.

25. A rolling mill provided with a pair of work rolls for rolling a plate, a pair of intermediate rolls supporting said pair of work rolls, respectively and a pair of backup rolls supporting said pair of intermediate rolls, respectively, in a mill stand, wherein said pair of backup rolls are arranged so that the axial lines of said pair of backup rolls do not incline to each other in a horizontal plane, said intermediate rolls and work rolls are arranged so that each of the axial lines of said intermediate rolls and work rolls can incline, in the counter direction to each other, to the axial lines of said backup rolls in a horizontal plane, the axial lines of said intermediate rolls and the axial lines of said work rolls in contact with said intermediate rolls being inclined in the counter direction to each other with respect to a width direction of the rolling plate, and a lubricant supplying apparatus is provided for supplying lubricant to the roll surfaces of said work rolls, intermediate rolls and backup rolls.

26. A rolling mill provided with a pair of work rolls for rolling a plate, a pair of intermediate rolls supporting said pair of work rolls, respectively and a pair of backup rolls supporting said pair of intermediate rolls, respectively, in a mill stand, wherein said pair of backup rolls are arranged so that the axial lines of said pair of backup rolls do not incline to each other in a horizontal plane, said intermediate rolls and work rolls are arranged so that each of the axial lines of said intermediate rolls and work rolls can incline, in a counter direction to each other, to the axial lines of said backup rolls in a horizontal plane, the axial lines of said intermediate rolls and the axial lines of said work rolls in contact with said intermediate rolls being inclined in the counter direction to each other with respect to the axial lines of said backup rolls, and a lubricant supplying apparatus is provided for supplying lubricant to the roll surfaces of said work rolls, intermediate rolls and backup rolls.

27. A rolling mill according to claim 26, wherein a cross angle of said work rolls is set so that thrust force occurring at said work rolls does not become excessively large, and a cross angle of said intermediate rolls is set so that said plate has a desired thickness distribution, taking into consideration the cross angle of said work rolls.

28. A rolling mill according to claim 26, wherein in a case where an angle of each work roll to a direction perpendicular to a rolling direction of said plate is defined as a cross angle of work roll and an angle of each intermediate roll to a direction perpendicular to a rolling direction of said plate is defined as a cross angle of intermediate roll, a cross angle of said work roll is set at 0.2 degrees or more, and a cross angle of said intermediate roll is set at 0.1 degrees or more counter to said work roll.

29. A rolling mill according to claim 26, wherein a roll bender is provided for imparting bending force on at least one side of said work rolls and said intermediate rolls.

30. A rolling mill according to claim 26, wherein a roll shift apparatus is provided which is able to shift at least one kind rolls selected from said work rolls and said intermediate rolls in an axial direction.

31. A rolling mill according to claim 26, wherein said lubricant is a lubrication oil comprising mineral oil as a base oil, and hot rolling is effected.

32. A rolling mill according to claim 26, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

33. A rolling mill according to claim 1, wherein a coolant supplying apparatus is provided for supplying coolant to said work rolls, said lubricant is a lubricant which differs in oily property or concentration from the coolant for said work rolls, and cold rolling is performed.

34. A rolling mill according to claim 1, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

35. A rolling mill according to claim 27, wherein said lubricant is a lubrication oil comprising mineral oil as a base oil, and hot rolling is effected.

36. A rolling mill according to claim 27, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

37. A rolling mill according to claim 27, wherein a coolant supplying apparatus is provided for supplying coolant to said work rolls, said lubricant is a lubricant which differs in oily property or concentration from the coolant for said work rolls, and cold rolling is performed.

38. A rolling mill according to claim 27, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

39. A rolling mill according to claim 28, wherein said lubricant is a lubrication oil comprising mineral oil as a base oil, and hot rolling is effected.

40. A rolling mill according to claim 28, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

41. A rolling mill according to claim 28, wherein a coolant supplying apparatus is provided for supplying coolant to said work rolls, said lubricant is a lubricant which differs in oily property or concentration from the coolant for said work rolls, and cold rolling is performed.

42. A rolling mill according to claim 28, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

43. A rolling mill according to claim 29, wherein as said roll bender, a work roll bender is provided for imparting bending force to said work rolls in a horizontal direction.

44. A rolling mill according to claim 29, wherein said lubricant is a lubrication oil comprising mineral oil as a base oil, and hot rolling is effected.

45. A rolling mill according to claim 29, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

46. A rolling mill according to claim 29, wherein a coolant supplying apparatus is provided for supplying coolant to said work rolls, said lubricant is a lubricant which differs in oily property or concentration from the coolant for said work rolls, and cold rolling is performed.

47. A rolling mill according to claim 29, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

48. A rolling mill according to claim 43, wherein said lubricant is a lubrication oil comprising mineral oil as a base oil, and hot rolling is effected.

49. A rolling mill according to claim 43, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

50. A rolling mill according to claim 43, wherein a coolant supplying apparatus is provided for supplying coolant to said work rolls, said lubricant is a lubricant which differs in oily property or concentration from the coolant for said work rolls, and cold rolling is performed.

51. A rolling mill according to claim 43, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

52. A rolling mill according to claim 30, wherein said lubricant is a lubrication oil comprising mineral oil as a base oil, and hot rolling is effected.

53. A rolling mill according to claim 30, wherein said rolling mill comprises a cooling water supplying apparatus for supplying cooling water to said work rolls and a cooling water shielding member arranged at a position adjacent to said work rolls for preventing said cooling water from adhering to said intermediate rolls, and performs hot rolling.

54. A rolling mill according to claim 30, wherein a coolant supplying apparatus is provided for supplying coolant to said work rolls, said lubricant is a lubricant which differs in oily property or concentration from the coolant for said work rolls, and cold rolling is performed.

55. A rolling mill according to claim 30, wherein said rolling mill comprises a coolant supplying apparatus for supplying coolant to said work rolls and a coolant shielding member arranged at a position adjacent to said work rolls for preventing said coolant from being adhered to said intermediate rolls, and effects cold rolling.

* * * * *